US009458670B2

(12) United States Patent
Russell

(10) Patent No.: US 9,458,670 B2
(45) Date of Patent: Oct. 4, 2016

(54) RAM ACCELERATOR SYSTEM WITH ENDCAP

(71) Applicant: HYPERSCIENCES, INC., Spokane, WA (US)

(72) Inventor: Mark C. Russell, Spokane, WA (US)

(73) Assignee: Hypersciences, Inc., Spokane, WA (US)

( * ) Notice: Subject to any disclaimer, the term of this patent is extended or adjusted under 35 U.S.C. 154(b) by 0 days.

(21) Appl. No.: 14/708,932

(22) Filed: May 11, 2015

(65) Prior Publication Data

US 2015/0330147 A1 Nov. 19, 2015

Related U.S. Application Data

(60) Provisional application No. 61/992,830, filed on May 13, 2014.

(51) Int. Cl.

| | |
|---|---|
| ***F41A 1/02*** | (2006.01) |
| ***E21B 7/00*** | (2006.01) |
| ***F41A 1/04*** | (2006.01) |

(52) U.S. Cl.

CPC ..... *E21B 7/007* (2013.01); *E21B 7/00* (2013.01); *F41A 1/02* (2013.01); *F41A 1/04* (2013.01)

(58) Field of Classification Search

CPC ..... F41A 1/02
USPC ..... 175/4.57, 4.58, 4.59
See application file for complete search history.

(56) References Cited

U.S. PATENT DOCUMENTS 2,544,573 A 3/1951 Vincent
2,621,732 A * 12/1952 Ahlgren ..... E21B 43/116 102/438
2,913,959 A * 11/1959 Mohaupt ..... E21B 7/061 102/301
3,185,224 A * 5/1965 Robinson, Jr. ..... E21B 7/007 102/301
3,441,095 A * 4/1969 Youmans ..... E21B 7/007 175/4.52
3,695,715 A 10/1972 Godfrey
3,863,723 A 2/1975 Godfrey
4,030,557 A 6/1977 Alvis et al.
4,123,975 A 11/1978 Mohaupt
4,467,878 A * 8/1984 Ibsen ..... E21B 43/117 175/4.59
4,582,147 A 4/1986 Dardick (Continued)

OTHER PUBLICATIONS

Young, Lee W., "Patent Cooperation Treaty International Search Report and Written Opinion dated May 16, 2014", Patent Cooperation Treaty Application No. PCT/US2014/012317, Patent Cooperation Treaty, May 16, 2014.

(Continued)

*Primary Examiner* — Troy Chambers
*Assistant Examiner* — Joshua Semick
(74) *Attorney, Agent, or Firm* — Lindauer Law, PLLC

(57) ABSTRACT

One or more ram accelerator devices may be used to form one or more holes in geologic or other material. These holes may be used for drilling, tunnel boring, excavation, and so forth. The ram accelerator devices propel projectiles which are accelerated by combustion of one or more combustible gasses in a ram effect to reach velocities exceeding 500 meters per second. An endcap may be deployed within a tube of the ram accelerator device to prevent incursion of formation pressure products such as oil, water, mud, gas, and so forth into a guide tube of the ram accelerator. During operation the projectile penetrates the endcap and at least a portion thereof impact a working face. In some implementations a purge gas may be used to form a ullage between the endcap and the working face.

15 Claims, 17 Drawing Sheets

(56) References Cited

U.S. PATENT DOCUMENTS

| | | | | |
|---|---|---|---|---|
| 4,638,712 | A * | 1/1987 | Chawla | E21B 43/116 175/4.57 |
| 4,679,637 | A | 7/1987 | Cherrington et al. | |
| 4,722,261 | A | 2/1988 | Titus | |
| 4,982,647 | A | 1/1991 | Hertzberg et al. | |
| 5,097,743 | A | 3/1992 | Hertzberg et al. | |
| 5,098,163 | A | 3/1992 | Young, III | |
| 5,574,244 | A | 11/1996 | Powell et al. | |
| 5,578,783 | A | 11/1996 | Brandeis | |
| 5,768,940 | A | 6/1998 | Kawaguchi et al. | |
| 5,833,003 | A * | 11/1998 | Longbottom | E21B 7/007 166/298 |
| 5,996,709 | A | 12/1999 | Norris | |
| 6,000,479 | A | 12/1999 | Ambs | |
| 6,035,784 | A * | 3/2000 | Watson | E21B 43/117 102/312 |
| 6,457,417 | B1 | 10/2002 | Beal | |
| 6,467,387 | B1 * | 10/2002 | Espinosa | E21B 43/116 102/326 |
| 6,591,731 | B2 | 7/2003 | Goldstein | |
| 7,942,481 | B2 * | 5/2011 | Leppanen | E21C 37/12 175/4.57 |
| 8,943,970 | B2 * | 2/2015 | Greeley | F42D 1/043 102/202 |
| 9,169,695 | B1 * | 10/2015 | Calvert | E21B 43/116 |
| 2007/0044963 | A1 | 3/2007 | MacDougall | |
| 2008/0205191 | A1 | 8/2008 | Coste et al. | |
| 2010/0032206 | A1 | 2/2010 | Becker et al. | |
| 2011/0114388 | A1 | 5/2011 | Lee et al. | |
| 2014/0260930 | A1 * | 9/2014 | Russell | F41A 1/04 89/7 |

OTHER PUBLICATIONS

Young, Lee W., "Patent Cooperation Treaty International Search Report and Written Opinion dated Jan. 8, 2016", Patent Cooperation Treaty Application No. PCT/US2015/056947, Patent Cooperation Treaty, Jan. 8, 2016.

Becamel, Philippe, "Patent Cooperation Treaty International Preliminary Report on Patentability dated Sep. 15, 2015", Patent Cooperation Treaty Application PCT/US2014/012317, Sep. 15, 2015.

Copenheaver, Blaine R., "Patent Cooperation Treaty International Search Report and Written Opinion dated Aug. 10, 2015", Patent Cooperation Treaty Application No. PCT/US2015/030320, Patent Cooperation Treaty, Aug. 10, 2015.

Committee on Advance Drilling, "Drilling and Excavation Technologies for the Future", National Research Council, ISBN: 0-309-57320-3, <<Retrieved from http://www.nap.edu/catalog/2349.html>>, 1994, 176.

Gold, et al., "Concrete Penetration by Eroding Projectiles Experiments and Analysis", Journal of Engineering Mechanics, v122, pp. 145-152 <<Retrieved from ascelibrary.org on Feb. 17, 2013>>, Feb. 1996, 145-152.

Gold, et al., "Constitutive Models for Concrete Penetration Analysis", Journal of Engineering Mechanics v122 <<Retrieved from ascelibrary.org on Feb. 17, 2013 >>, Mar. 1996, 230-238.

Lundquist, "Underground Tests of the Ream Method of Rock Fragmentation for High-Speed Tunneling", Rapid Excavation and Tunneling Conference Proceedings, Ch 56<<Retrieved from http://www.onemine.org/view/?d=689528D8459E7257609C73381053FBF203FD5CC5A9FC7839952A414670F0591638551, Mar. 13, 2013>>, Jan. 1974, 825-840.

Weber, Jonathan C., "Non-Final Office Action dated Jun. 1, 2015", U.S. Appl. No. 13/841,236, The United States Patent and Trademark Office, filed Jun. 1, 2015.

* cited by examiner

RAM ACCELERATOR SYSTEM WITH ENDCAP

PRIORITY

This application claims priority to U.S. Provisional Patent Application Ser. No. 61/992,830 filed on May 13, 2014, titled "Ram Accelerator System With Endcap", the contents of which are incorporated by reference into the present disclosure.

BACKGROUND

Traditional drilling and excavation methods utilize drills to form holes in one or more layers of material to be penetrated. Excavation, quarrying, and tunnel boring may also use explosives placed in the holes and detonated in order to break apart at least a portion of the material. The use of explosives results in additional safety and regulatory burdens which increase operational cost. Typically these methods cycle from drill, blast, removal of material, ground support and are relative slow (many minutes to hours to days per linear foot is typical depending on the cross-sectional area being moved) methods for removing material to form a desired excavation.

BRIEF DESCRIPTION OF DRAWINGS

Certain implementations and embodiments will now be described more fully below with reference to the accompanying figures, in which various aspects are shown. However, various aspects may be implemented in many different forms and should not be construed as limited to the implementations set forth herein. The figures are not necessarily to scale, and the relative proportions of the indicated objects may have been modified for ease of illustration and not by way of limitation. Like numbers refer to like elements throughout.

DETAILED DESCRIPTION

Figure 1:
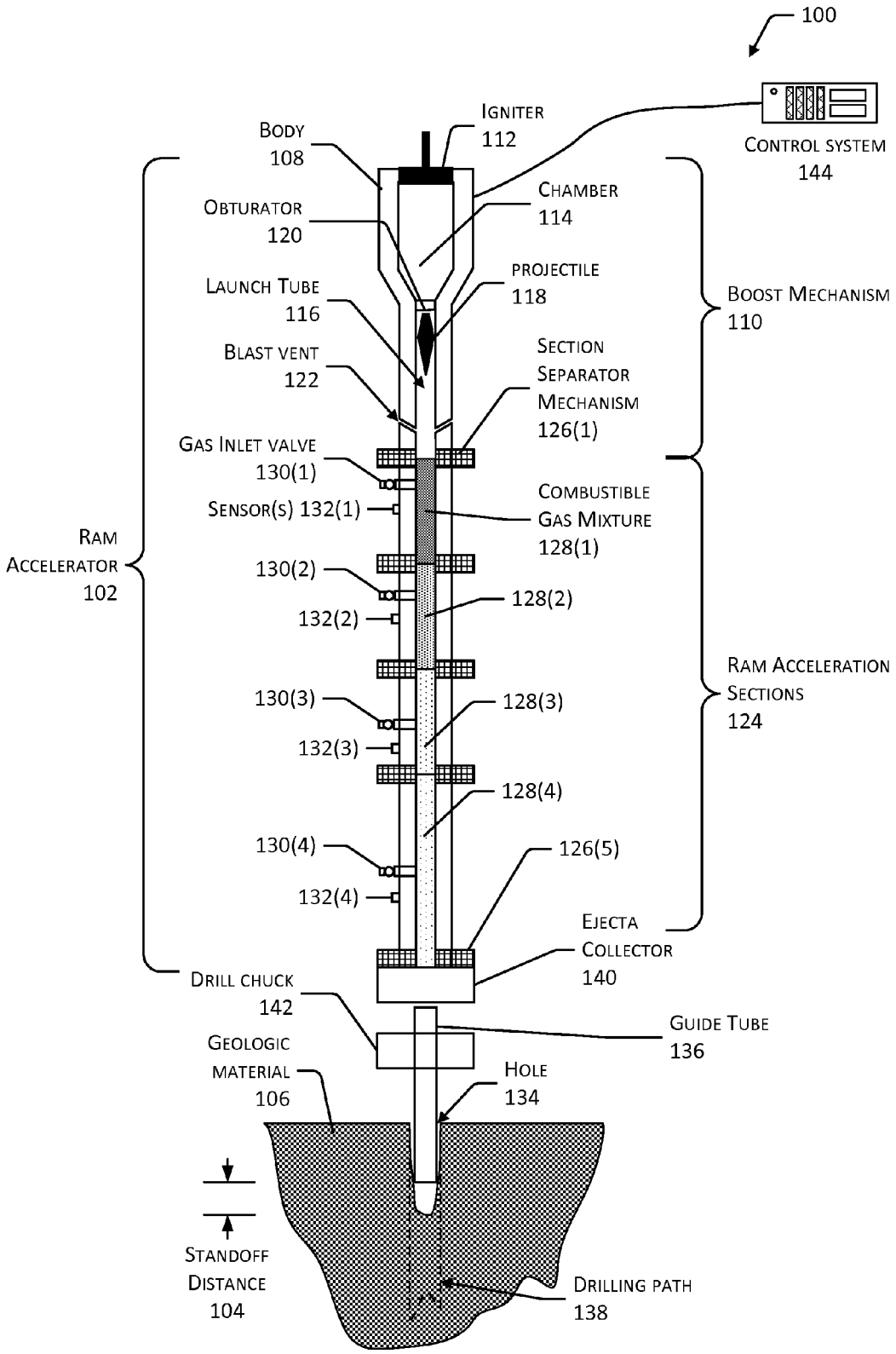
FIG. 1 is an illustrative system for drilling or excavating using a ram accelerator comprising a plurality of sections holding one or more combustible gasses configured to propel a projectile towards a working face of material.

Conventional drilling and excavation techniques used for penetrating materials typically rely on mechanical bits used to cut or grind at a working face. These materials may include metals, ceramics, geologic materials, and so forth. Tool wear and breakage on the mechanical bits slows these operations, increasing costs. Furthermore, the rate of progress of cutting through material such as hard rock may be prohibitive. Drilling may be used in the establishment of water wells, oil wells, gas wells, underground pipelines, and so forth. Additionally, the environmental impact of conventional techniques may be significant. For example, conventional drilling may require a significant supply of water which may not be readily available in arid regions. As a result, resource extraction may be prohibitively expensive, time consuming, or both.

Described in this disclosure are systems and techniques for using a ram accelerator to eject one or more projectiles toward the working face of the geologic material to form a hole. The ram accelerator includes a launch tube separated into multiple sections. Each of the sections is configured to hold one or more combustible gases. A projectile is boosted to a ram velocity down the launch tube and through the multiple sections. At the ram velocity, a ram compression effect provided at least in part by a shape of the projectile initiates combustion of the one or more combustible gasses in a ram combustion effect, accelerating the projectile. In some implementations, the projectile may accelerate to a hypervelocity. In some implementations, hypervelocity includes velocities greater than or equal to two kilometers per second upon ejection or exit from the ram accelerator launch tube. In other implementations, the projectile may accelerate to a non-hypervelocity. In some implementations, non-hypervelocity includes velocities below two kilometers per second.

The projectiles ejected from the ram accelerator strike a working face of the geologic material. Projectiles travelling at hypervelocity typically interact with the geologic material at the working face as a fluid-fluid interaction upon impact, due to the substantial kinetic energy in the projectile. This interaction forms a hole which is generally in the form of a cylinder. By firing a series of projectiles, a hole may be formed or drilled through the geologic material. In comparison, projectiles travelling at non-hypervelocity interact with the geologic material at the working face as a solid-solid interaction. This interaction may fracture or fragment the geologic material, and may form a hole which is cylindrical or a crater having a conical profile.

A section separator mechanism is configured provide one or more barriers between the different sections in the ram accelerator which contain the one or more combustible gasses. Each section may be configured to contain one or more combustible gasses in various conditions such as particular pressures, and so forth. The section separator mechanism may employ a diaphragm, valve, and so forth which is configured to seal one or more sections. During firing, the projectile passes through the diaphragm, breaking the seal, or the valve is opened prior to launch. A reel mechanism may be used to move an unused section of the diaphragm into place, restoring the seal. Other separator mechanisms such as ball valves, plates, endcaps, gravity gradient, and so forth may also be used. The separator mechanisms may be configured to operate as blow out preventers, anti-kick devices, and so forth. For example, the separator mechanisms may comprise ball valves configured to close when pressure from down the hole exceeds a threshold pressure.

The hole formed by the impact of the projectiles may be further guided or processed. A guide tube (also known as a "drift tube") may be inserted into the hole to prevent subsidence, direct a drilling path, deploy instrumentation, and so forth. In one implementation, a reamer or slip-spacer may be coupled to the guide tube and inserted downhole. The reamer may comprise one or more cutting or grinding surfaces configured to shape the hole into a substantially uniform cross section. For example, the reamer may be configured to smooth the sides of the hole.

The reamer may also be configured to apply lateral force between the guide tube and the walls of the hole, canting or otherwise directing the drill in a particular direction. This directionality enables the ram accelerator to form a curved drilling path.

The guide tube is configured to accept the projectiles ejected from the ram accelerator and direct them towards the working face. A series of projectiles may be fired from the ram accelerator down the guide tube, allowing for continuous drilling operations. Endcaps may be used during operation to improve performance of the system. The projectiles may pierce the endcaps to arrive at the working face. Other operations may also be provided, such as inserting a continuous concrete liner into the hole.

Ejecta comprising materials resulting from the impact of the one or more projectiles with the geologic material may be removed from the hole. In some implementations, a back pressure resulting from the impact may force the ejecta from the hole. In some implementations a working fluid such as compressed air, water, and so forth may be injected into the hole to aid in removal of at least a portion of the ejecta. The injection may be done continuously, prior to, during, or after, each launch of the projectile.

One or more ram accelerators may also be deployed to drill several holes for tunnel boring, excavation, and so forth. A plurality of accelerators may be fired sequentially or simultaneously to strike one or more target points on a working face. After several holes are formed from projectile impacts, various techniques may be used to remove pieces of geologic material defined by two or more holes which are proximate to one another. Mechanical force may be applied by breaker arms to snap, break, or otherwise free pieces of the geologic material from a main body of the geologic material at the working face. In other implementations, conventional explosives may be placed into the ram accelerator drilled holes and detonated to shatter the geologic material.

In some implementations, conventional drilling techniques and equipment may be used in conjunction with ram accelerator drilling. For example, ram accelerator drilling may be used to reach a particular target depth. Once at the target depth, a conventional coring drill may be used to retrieve core samples from strata at the target depth.

The systems and techniques described may be used to reduce the time, costs, and environmental necessary for resource extraction, resource exploration, construction, and so forth. Furthermore, the capabilities of ram accelerator drilling enable deeper exploration and recovery of natural resources. Additionally, the energy released during impact may be used for geotechnical investigation such as reflection seismology, strata characterization, and so forth.

Illustrative Systems, Mechanisms, and Processes

FIG. 1 is an illustrative system 100 for drilling or excavating using a ram accelerator 102. A ram accelerator 102 may be positioned at a standoff distance 104 from geologic material 106 or target material. The geologic material 106 may comprise rock, dirt, ice, and so forth. The ram accelerator 102 has a body 108. The body 108 may comprise one or more materials such as steel, carbon fiber, ceramics, and so forth.

The ram accelerator 102 includes boost mechanism 110. The boost mechanism 110 may include one or more of a gas gun, electromagnetic launcher, solid explosive charge, liquid explosive charge, backpressure system, and so forth. The boost mechanism 110 may operate by providing a relative differential in speed between a projectile 118 and particles in the one or more combustible gasses which is equal to or greater than a ram velocity. The ram velocity is the velocity of the projectile 118, relative to particles in the one or more combustible gasses, at which the ram effect occurs. In some implementations, at least a portion of the launch tube 116 within the boost mechanism 110 may be maintained at a vacuum prior to launch.

In the example depicted here the boost mechanism comprises a detonation gas gun, including an igniter 112 coupled to a chamber 114. The chamber 114 may be configured to contain one or more combustible or explosive or detonable materials which, when triggered by the igniter 112, generate an energetic reaction. In the gas gun implementation depicted, the chamber 114 is coupled to a launch tube 116 within which the projectile 118 is placed. In some implementations, the projectile 118 may include or be adjacent to an obturator 120 configured to seal at least temporarily the chamber 114 from the launch tube 116. The obturator 120 may be attached, integrated but frangible or separate from but in-contact with the projectile 118. One or more blast vents 122 may be provided to provide release of the reaction byproducts. In some implementations the launch tube 116 may be smooth, rifled, include one or more guide rails or other guide features, and so forth. The launch tube 116, or portions thereof, may be maintained at a pressure which is lower than that of the ambient atmosphere. For example, portions of the launch tube 116 such as those in the boost mechanism 110 may be evacuated to a pressure of less than 25 torr.

The boost mechanism 110 is configured to initiate a ram effect with the projectile 118. The ram effect results in compression of one or more combustible gasses by the projectile 118 and subsequent combustion proximate to a back side of the projectile 118. This compression results in heating of the one or more combustible gasses, triggering ignition. The ignited gasses combusting in an exothermic reaction, impart an impulse on the projectile 118 which is accelerated down the launch tube 116. In some implementations ignition may be assisted or initiated using a pyrotechnic igniter. The pyrotechnic igniter may either be affixed to or a portion of the projectile 118, or may be arranged within the launch tube.

The boost mechanism 110 may use an electromagnetic, solid explosive charge, liquid explosive charge, stored compressed gasses, and so forth to propel the projectile 118 along the launch tube 116 at the ram velocity. In some implementations a backpressure system may be used. The backpressure system accelerates at least a portion of the one or more combustible gasses past a stationary projectile 118, producing the ram effect in an initially stationary projectile 118. For example, the combustible gas mixture under high pressure may be exhausted from ports within the launch tube 116 past the projectile 118 as it rests within the launch tube 116. This relative velocity difference achieves the ram velocity, and the ram effect of combustion begins and pushes the projectile 118 down the launch tube 116. Hybrid systems may also be used, in which the projectile 118 is moved and backpressure is applied simultaneously.

The projectile 118 passes along the launch tube 116 from the boost mechanism 110 into one or more ram acceleration sections 124. The ram acceleration sections 124 (or "sections") may be bounded by section separator mechanisms 126. The section separator mechanisms 126 are configured to maintain a combustible gas mixture 128 which has been admitted into the section 124 via one or more gas inlet valves 130 in the particular section 124. Each of the different sections 124 may have a different combustible gas mixture 128.

The section separator mechanisms 126 may include valves such as ball valves, diaphragms, gravity gradient, liquids, endcaps, or other structures or materials configured to maintain the different combustible gas mixtures 128 substantially within their respective sections 124. In one implementation described below with regard to FIG. 3, the diaphragm may be deployed using a reel mechanism, allowing for relatively rapid reset of the diaphragms following their penetration by the projectile 118 during operation of the ram accelerator 1022. In other implementations the launch tube 116 may be arranged at an angle which is not perpendicular to local vertical, such that gravity holds the different combustible gas mixtures 128 at different heights, based on their relative densities. For example, lighter combustible gas mixtures 128 "float" on top of heavier combustible gas mixtures 128 which sink or remain on the bottom of the launch tube 116. In another example, fluid at the bottom of the hole 134 may provide a seal which allows the guide tube 136 to be filled with a combustible gas mixture 128 and used as a ram acceleration section 124.

In this illustration four sections 124(1)-(4) are depicted, as maintained by five section separator mechanisms 126(1)-(5). When primed for operation, each of the sections 124(1)-(4) are filled with the combustible gas mixtures 128(1)-(4). In other implementations, different numbers of sections 124, section separator mechanisms 126, and so forth may be used.

The combustible gas mixture 128 may include one or more combustible gasses. The one or more combustible gasses may include an oxidizer or an oxidizing agent. For example, the combustible gas mixture 128 may include hydrogen and oxygen gas in a ratio of 2:1. Other combustible gas mixtures may be used, such as silane and carbon dioxide. The combustible gas mixture 128 may be provided by extraction from ambient atmosphere, electrolysis of a material such as water, from a solid or liquid gas generator using solid materials which react chemically to release a combustible gas, from a previously stored gas or liquid, and so forth.

The combustible gas mixtures 128 may be the same or may differ between the sections 124. These differences include chemical composition, pressure, temperature, and so forth. For example, the density of the combustible gas mixture 128 in each of the sections 124(1)-(4) may decrease along the launch tube 116, such that the section 124(1) holds the combustible gas 128 at a higher pressure than the section 124(4). In another example, the combustible gas mixture 128(1) in the section 124(1) may comprise oxygen and propane while the combustible gas mixture 128(3) may comprise oxygen and hydrogen.

One or more sensors 132 may be configured at one or more positions along the ram accelerator 102. These sensors 132 may include pressure sensors, chemical sensors, density sensors, fatigue sensors, strain gauges, accelerometers, proximity sensors, and so forth.

The ram accelerator 102 is configured to eject the projectile 118 from an ejection end of the launch tube 116 and towards a working face of the geologic material 106 or other geologic material 106. Upon impact, a hole 134 may be formed. The ejection end is the portion of the ram accelerator 102 which is proximate to the hole 134.

A series of projectiles 118 may be fired, one after another, to form a hole which grows in length with each impact. The ram accelerator 102 may accelerate the projectile 118 to a hypervelocity. As used in this disclosure, hypervelocity includes velocities greater than or equal to two kilometers per second upon ejection or exit from the ram accelerator launch tube.

In other implementations, the projectile may accelerate to a non-hypervelocity. Non-hypervelocity includes velocities below two kilometers per second. Hypervelocity and non-hypervelocity may also be characterized based on interaction of the projectile 118 with the geologic material 106 or other materials. For example, hypervelocity impacts are characterized by a fluid-fluid type interaction, while non-hypervelocity impacts are not. These interactions are discussed below in more detail with regard to FIGS. 6 and 7.

In some implementations a guide tube 136 may be inserted into the hole 134. The interior of the guide tube 136 may be smooth, rifled, include one or more guide rails or other guide features, and so forth. The guide tube 136 provides a pathway for projectiles 118 to travel from the ram accelerator 102 to the portion of the geologic material 106 which are being drilled. The guide tube 136 may also be used to prevent subsidence, direct a drilling path, deploy instrumentation, deploy a reamer, and so forth. The guide tubes 136 may thus follow along a drilling path 138 which is formed by successive impacts of the projectiles 118. The guide tube 136 may comprise a plurality of sections coupled together, such as with threads, clamps, and so forth. The guide tube 136 may be circular, oval, rectangular, triangular, or describe a polyhedron in cross section. The guide tube 136 may comprise one or more tubes or other structures which are nested one within another. For example the guide tube 136 may include an inner tube and an outer tube which are mounted coaxially, or with the inner tube against one side of the outer tube.

Formation of the hole 134 using the impact of the projectiles 118 result in increased drilling speed compared to conventional drilling by minimizing work stoppages associated with adding more guide tube 136. For example, following repeated followings, the standoff distance 104 may increase to a distance of zero to hundreds of feet. After extending the hole 134 using several projectiles 118, firing may cease while one or more additional guide tube 136 sections are inserted. In comparison, conventional drilling may involve stopping every ten feet to add a new section of drill pipe, which results in slower progress.

The direction of the drilling path 138 may be changed by modifying one or more firing parameters of the ram accelerator 102, moving the guide tube 136, and so forth. For example, reamers on the guide tube 136 may exert a lateral pressure by pushing against the walls of the hole 134, bending or tilting the guide tube 136 to a particular direction.

An ejecta collector 140 is configured to collect or capture at least a portion of ejecta which results from the impacts of the one or more projectiles 118. The ejecta collector 140 may be placed proximate to a top of the hole 134, such as coupled to the guide tube 136.

In some implementations a drill chuck 142 may be mechanically coupled to the guide tube 136, such that the guide tube 136 may be raised, lowered, rotated, tilted, and so forth. Because the geologic material 106 is being removed by the impact of the projectiles 118, the end of the guide tube 136 is not carrying the loads associated with traditional mechanical drilling techniques. As a result, the drill chuck 142 with the ram accelerator system may apply less torque to the guide tube 136, compared to conventional drilling.

The ram accelerator 102 may be used in conjunction with conventional drilling techniques. This is discussed in more detail below with regard to FIG. 2.

In some implementations an electronic control system 144 may be coupled to the ram accelerator 102, the one or more sensors 132, one or more sensors in the projectiles 118, and so forth. The control system 144 may comprise one or more processors, memory, interfaces, and so forth which are configured to facilitate operation of the ram accelerator 102. The control system 144 may couple to the one or more section separator mechanisms 126, the gas inlet valves 130, and the sensors 132 to coordinate the configuration of the ram accelerator 102 for ejection of the projectile 118. For example, the control system 144 may fill particular combustible gas mixtures 128 into particular sections 124 and recommend a particular projectile 118 type to use to form a particular hole 134 in particular geologic material 106.

In some implementations, instead of or in addition to the section separator mechanism 126, baffles or annular members may be placed within the ram acceleration sections 124. The baffles are configured to allow passage of the projectile 118 during operation.

Other mechanisms may be present which are not depicted here. For example, an injection system may be configured to add one or more materials into the wake of the projectiles 118. These materials may be used to clean the launch tube 116, clean the guide tube 136, remove debris, and so forth. For example, powdered silica may be injected into the wake of the projectile 118, such that at least a portion of the silica is pulled along by the wake down the launch tube 116, into the hole 134, or both.

In some implementations a drift tube may be positioned between the launch tube 116 and the guide tube 136 or the hole 134. The drift tube may be configured to provide a consistent pathway for the projectile 118 between the two.

Figure 2:
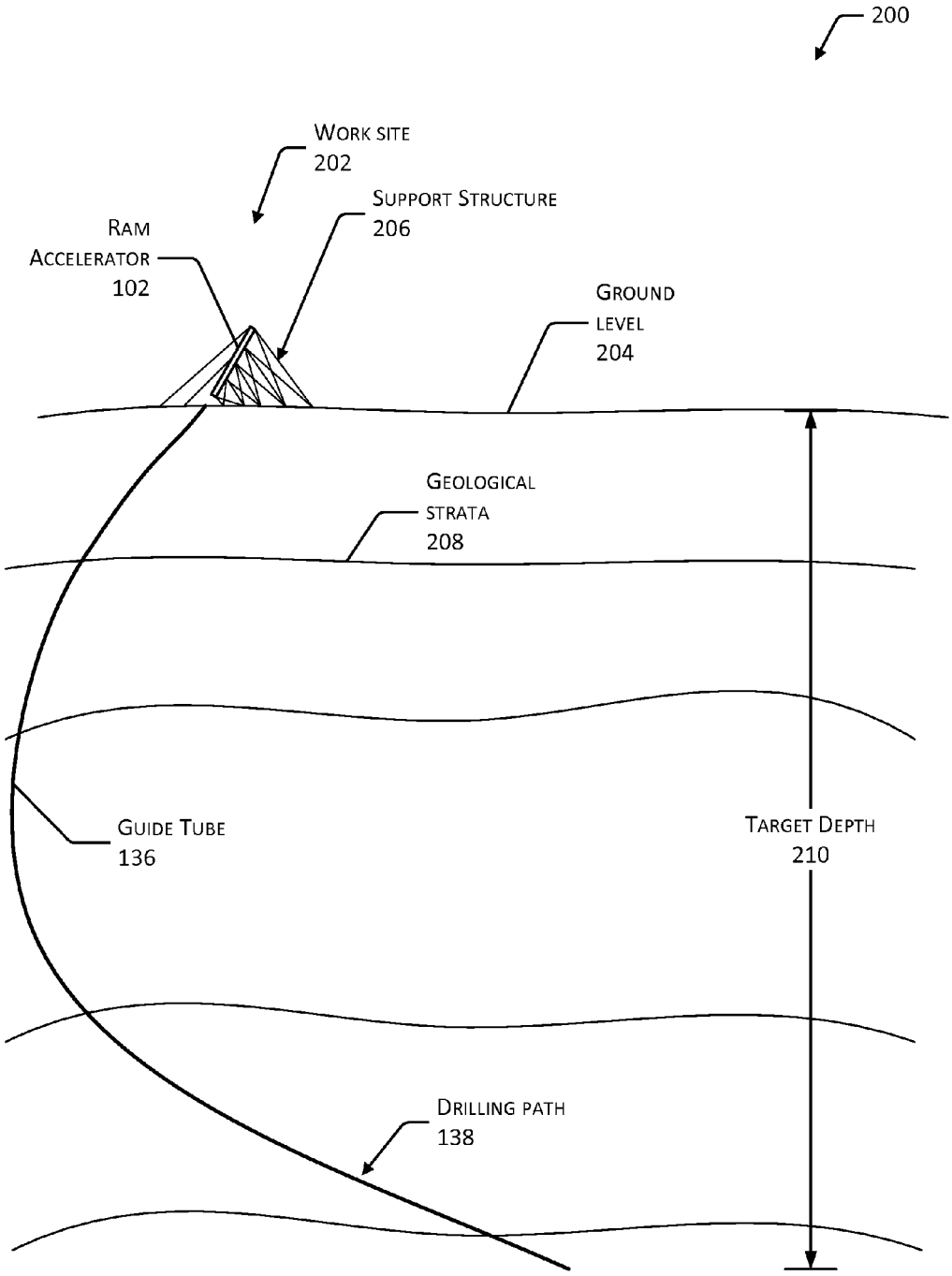
FIG. 2 illustrates a curved drilling path formed using ram accelerator drilling.

FIG. 2 illustrates a scenario 200 in which a curved drilling path 138 formed at least in part by ram accelerator drilling. In this illustration a work site 202 is shown at ground level 204. At the work site 202, a support structure 206 holds the ram accelerator 102. For example, the support structure 206 may comprise a derrick, crane, scaffold, and so forth. In some implementations, the overall length of the ram accelerator 102 may be between 75 to 300 feet. The support structure 206 is configured to maintain the launch tube 116 in a substantially straight line, in a desired orientation during firing. By minimizing deflection of the launch tube 116 during firing of the projectile 118, side loads exerted on the body 108 are reduced. In some implementations a plurality of ram accelerators 102 may be moved in and out of position in front of the hole 134 to fire their projectiles 118, such that one ram accelerator 102 is firing while another is being loaded.

The ram accelerator 102 may be arranged vertically, at an angle, or horizontally, depending upon the particular task. For example, while drilling a well the ram accelerator 102 may be positioned substantially vertically. In comparison, while boring a tunnel the ram accelerator 102 may be positioned substantially horizontally.

The drilling path 138 may be configured to bend or curve along one or more radii of curvature. The radius of curvature may be determined based at least in part on the side loads imposed on the guide tube 136 during transit of the projectile 118 within.

The ability to curve allows the drilling path 138 to be directed such that particular points in space below ground level 204 may be reached, or to avoid particular regions. For example, the drilling path 138 may be configured to go around a subsurface reservoir. In this illustration, the drilling path 138 passes through several layers of geological strata 208, to a final target depth 210. At the target depth 210, or at other points in the drilling path 138 during impacting, the ejecta from the impacts of the projectiles 118 may be analyzed to determine composition of the various geological strata 208 which the end of the drilling path 138 is passing through.

In some implementations the ram accelerator 102, or a portion thereof may extend or be placed within the hole 134. For example, the ram accelerator 102 may be lowered down the guide tube 136 and firing may commence at a depth below ground level. In another implementation, the guide tube 136, or a portion thereof, may be used as an additional ram acceleration section 124. For example, a lower portion of the guide tube 136 in the hole 134 may be filled with a combustible gas to provide acceleration prior to impact.

Drilling with the ram accelerator 102 may be used in conjunction with conventional drilling techniques. For example, the ram accelerator 102 may be used to rapidly reach a previously designated target depth 210 horizon. At that point, use of the ram accelerator 102 may be discontinued, and conventional drilling techniques may use the hole 134 formed by the projectiles 118 for operations such as cutting core samples and so forth. Once the core sample or other operation has been completed for a desired distance, use of the ram accelerator 102 may resume and additional projectiles 118 may be used to increase the length of the drilling path 138.

In a another implementation, the projectile 118 may be shaped in such a way to capture or measure in-flight the material characteristics of the geologic material 106 or analyze material interaction between material comprising the projectile 118 and the geologic material 106 or other target material. Samples of projectile 118 fragments may be recovered from the hole 134, such as through core drilling and recovery of the projectile. Also, sensors in the projectile 118 may transmit information back to the control system 144.

Figure 3:
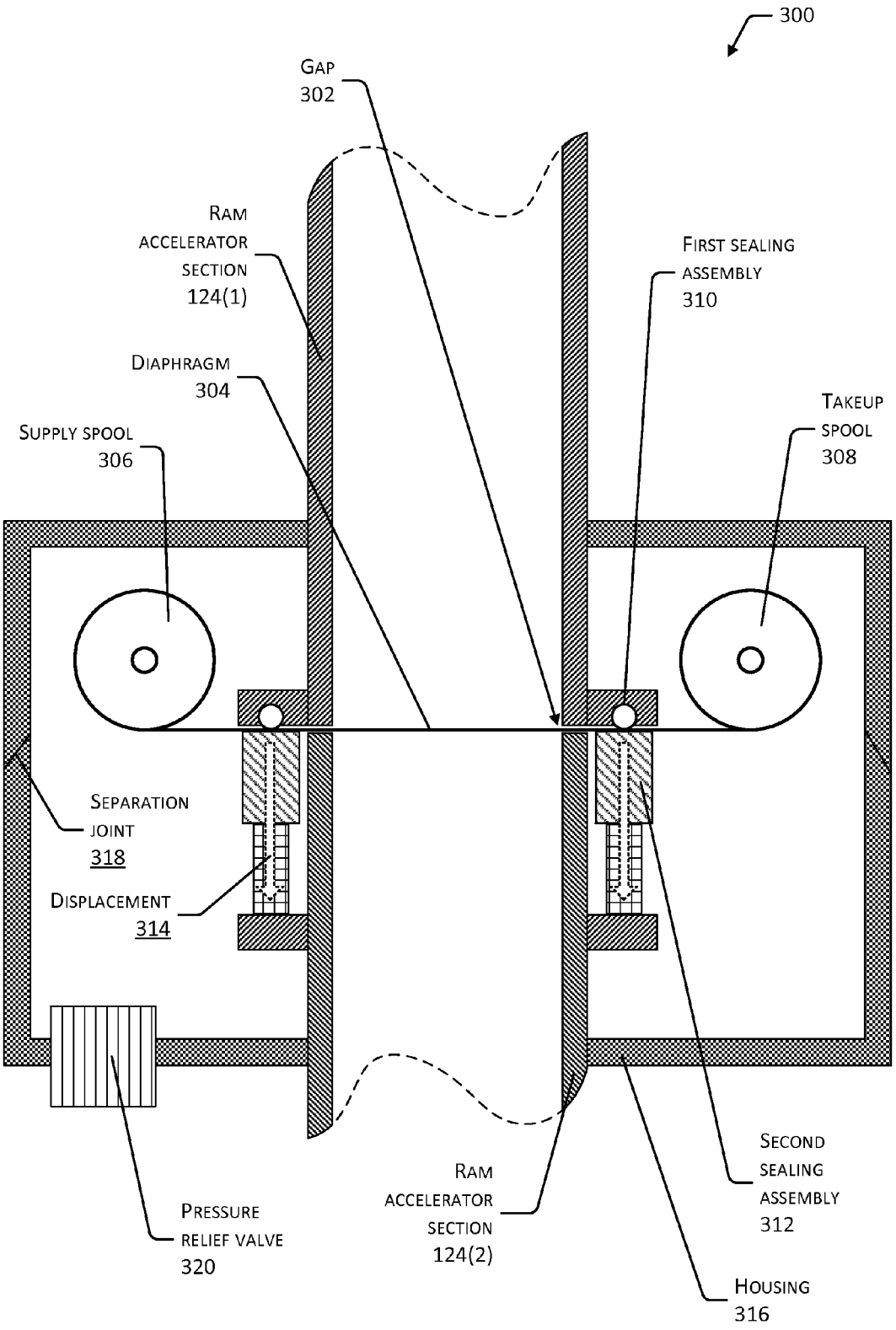
FIG. 3 illustrates a section separator mechanism configured to reset a diaphragm penetrated during launch of the projectile such that a seal is maintained between the sections of the ram accelerator.

FIG. 3 illustrates a mechanism 300 of one implementation of a section separator mechanism 126. As described above, several techniques and mechanisms may be used to maintain the different combustible gas mixtures 128 within particular ram accelerator sections 124.

The mechanism 300 depicted here may be arranged at one or more ends of a particular section 124. For example, the mechanism 300 may be between the sections 124(1) and 124(2) as shown here, at the ejection end of the section 124(4) which contains the combustible gas mixture 128(4), and so forth.

A gap 302 is provided between the ram accelerator sections 124. Through the gap 302, or in front of the launch tube 116 when on the ejection end, a diaphragm 304 extends. The diaphragm 304 is configured to maintain the combustible gas mixture 128 within the respective section, prevent ambient atmosphere from entering an evacuated section 124, and so forth.

The diaphragm 304 may comprise one or more materials including, but not limited to, metal, plastic, ceramic, and so forth. For example, the diaphragm 304 may comprise aluminum, steel, copper, Mylar, and so forth. In some implementations, a carrier or supporting matrix or structure may be arranged around at least a portion of the diaphragm 304 which is configured to be penetrated by the projectile 118 during firing. The portion of the diaphragm 304 which is configured to be penetrated may differ in one or more ways from the carrier. For example, the carrier may be thicker, have a different composition, and so forth. In some implementations the portion of the diaphragm 304 which is configured to be penetrated may be scored or otherwise designed to facilitate penetration by the projectile 118.

A supply spool 306 may store a plurality of diaphragms 304 in a carrier strip, or a diaphragm material, with penetrated diaphragms being taken up by a takeup spool 308.

A seal may be maintained between the section 124 and the diaphragm 304 by compressing a portion of the diaphragm 304 or the carrier holding the diaphragm 304 between a first sealing assembly 310 on the first ram accelerator section 124(1) and a corresponding second sealing assembly 312 on the second ram accelerator section 124(2). The second sealing assembly 312 is depicted here as being configured to be displaced as indicated along the arrow 314 toward or away from the first sealing assembly 310, to allow for making or breaking the seal and movement of the diaphragm 304.

During evacuation or filling of the section 124 with the combustible gas mixture 128, the intact diaphragm 304 as sealed between the first sealing assembly 310 and the second sealing assembly 312 seals the section 124. During the firing process, the projectile 118 penetrates the diaphragm 304, leaving a hole. After firing, material may be spooled from the supply spool 306 to the takeup spool 308, such that an intact diaphragm 304 is brought into the launch tube 116 and subsequently sealed by the sealing assemblies.

A housing 316 may be configured to enclose the spools, sealing assembly, and so forth. Various access ports or hatches may be provided which allow for maintenance such as removing or placing the supply spool 306, the takeup spool 308, and so forth. A separation joint 318 may be provided which allows for separation of the first ram accelerator section 124(1) from the second ram accelerator section 124(2). The housing 316, the separation joint 318, and other structures may be configured to maintain alignment of the launch tube 116 during operation. The housing 316 may be configured with one or more pressure relief valves 320. These valves 320 may be used to release pressure resulting from operation of the ram accelerator 102, changes in atmospheric pressure, and so forth.

While the first ram accelerator section 124(1) from the second ram accelerator sections 124(2) are depicted in this example, it is understood that the mechanism 300 may be employed between other sections 124, at the end of other sections 124, and so forth.

In other implementations, instead of a spool, the diaphragm 304 may be arranged as plates or sheets of material. A feed mechanism may be configured to change these plates or sheets to replace penetrated diaphragms 304 with intact diaphragms.

The section separator mechanism 126 may comprise a plate configured to be slid in an out of the launch tube 116, such as a gate valve. Other valves such as ball valves may also be used. One or more of these various mechanisms may be used in the same launch tube 116 during the same firing operation. For example, the mechanism 300 may be used at the ejection end of the ram accelerator 102 while ball or gate valves may be used between the sections 124.

The section separator mechanisms 126 may be configured to fit within the guide tube 136, or be placed down within the hole 134. This arrangement allows the ram acceleration sections 124 to extend down the hole 134. For example, the mechanism 300 may be deployed down into the hole 134 such as an ongoing sequence of projectiles 118 may be fired down the hole.

Figure 4:
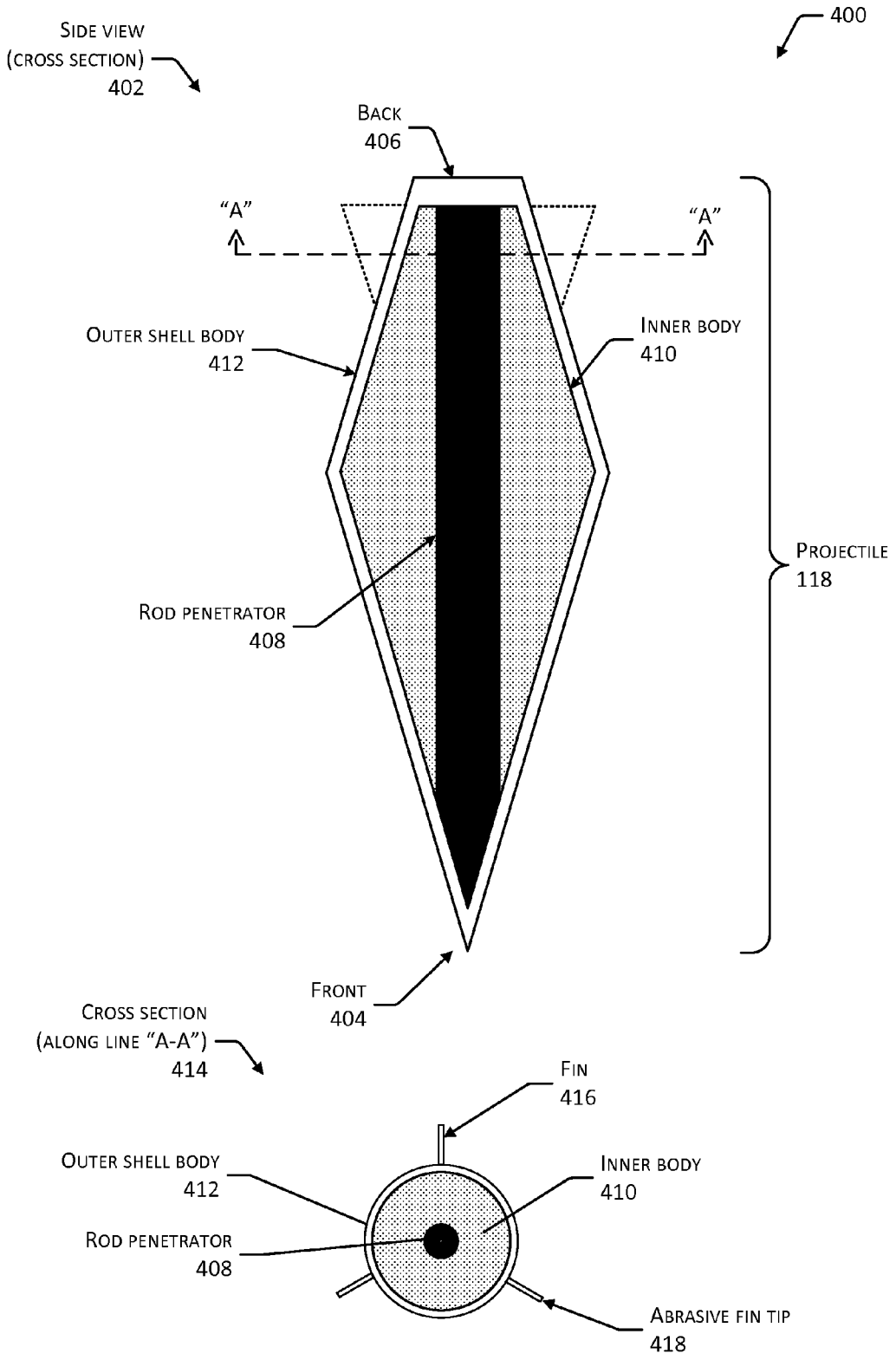
FIG. 4 illustrates a projectile configured to be accelerated using a ram combustion effect.

FIG. 4 illustrates several views 400 of the projectile 118. A side-view 402 depicts the projectile 118 as having a front 404, a back 406, a rod penetrator 408, and inner body 410, and an outer body 412. The front 404 is configured to exit the launch tube 116 before the back 406 during launch.

The rod penetrator 408 may comprise one or more materials such as metals, ceramics, plastics, and so forth. For example, the rod penetrator 408 may comprise copper, depleted uranium, and so forth.

The inner body 410 of the projectile 118 may comprise a solid plastic material or other material to entrain into the hole 134 such as, for example, explosives, hole cleaner, seepage stop, water, ice. A plastic explosive or specialized explosive may be embedded in the rod penetrator 408. As the projectile 118 penetrates the geologic material 106, the explosive is entrained into the hole 134 where it may be detonated. In another embodiment, the outer shell body 412 may be connected to a lanyard train configured to pull a separate explosive into the hole 134.

In some implementations, at least a portion of the projectile 118 may comprise a material which is combustible during conditions present during at least a portion of the firing sequence of the ram accelerator 102. For example, the outer shell body 412 may comprise aluminum. In some implementations, the projectile 118 may omit onboard propellant.

The back 406 of the projectile 118 may also comprise an obturator 120120 which is adapted to prevent the escape of the combustible gas mixture 128 past the projectile 118 as the projectile 118 accelerates through each section of the launch tube 116. The obturator 120 may be an integral part of the projectile 118 or a separate and detachable unit. Cross section 414 illustrates a view along the plane indicated by line A-A.

As depicted, the projectile 118 may also comprise one or more fins 416, rails, or other guidance features. For example, the projectile 118 may be rifled to induce spiraling. The fins 416 may be positioned to the front 404 of the projectile 118, the back 406, or both, to provide guidance during launch and ejection. The fins 416 may be coated with an abrasive material that aids in cleaning the launch tube 116 as the projectile 118 penetrates the geologic material 106. In some implementations one or more of the fin 416 may comprise an abrasive tip 418. In some implementations, the body of the projectile 118 may extend out to form a fin or other guidance feature. The abrasive tip 418 may be used to clean the guide tube 136 during passage of the projectile 118.

In some implementations the projectile 118 may incorporate one or more sensors or other instrumentation. The sensors may include accelerometers, temperature sensors, gyroscopes, and so forth. Information from these sensors may be returned to receiving equipment using radio frequencies, optical transmission, acoustic transmission, and so forth. This information be used to modify the one or more firing parameters, characterize material in the hole 134, and so forth.

Figure 5:
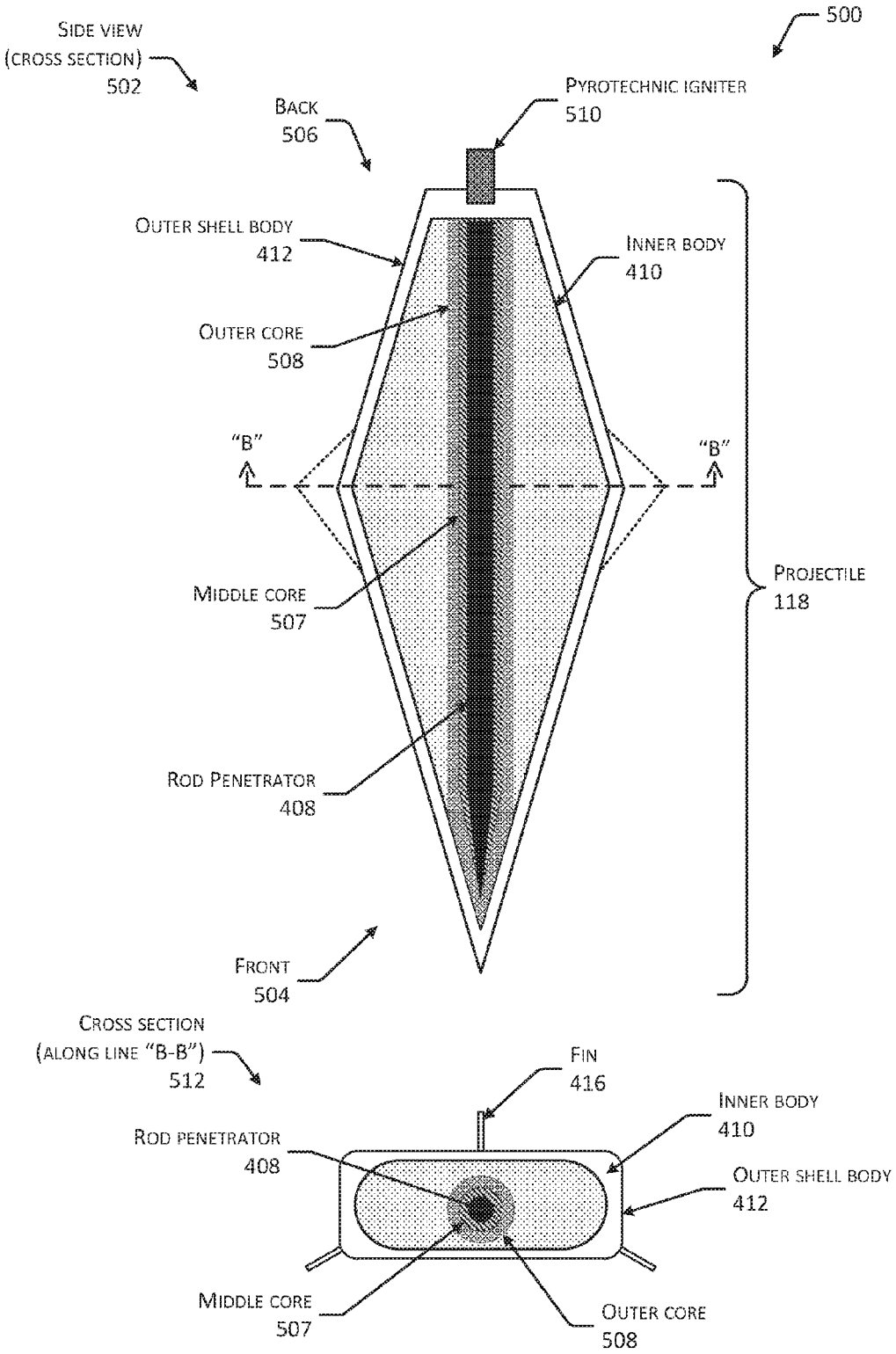
FIG. 5 illustrates a projectile configured with an abrasive inner core configured to provide abrasion of the material upon and subsequent to impact.

FIG. 5 illustrates several views 500 of another projectile 118 design. As shown here in a side view 502 showing a cross section, the projectile 118 has a front 504 and a back 506.

Within the projectile 118 is the rod penetrator 408. While the penetrator is depicted as a rod, in other implementations the penetrator may have one or more other shapes, such as a prismatic solid.

Similar to that described above, the projectile 118 may include a middle core 507 and an outer core 508. In some implementations one or both of these may be omitted. As also described above, the projectile 118 may include the inner body 410 and the outer shell body 412, albeit with a different shape from that described above with regard to FIG. 4.

The projectile 118 may comprise a pyrotechnic igniter 510. The pyrotechnic igniter 510 may be configured to initiate, maintain, or otherwise support combustion of the combustible gas mixtures 128 during firing.

Cross section 512 illustrates a view along the plane indicated by line B-B. As depicted, the projectile 118 may not be radially symmetrical. In some implementations the shape of the projectile 118 may be configured to provide guidance or direction to the projectile 118. For example, the projectile 118 may have a wedge or chisel shape. As above, the projectile 118 may also comprise one or more fins 416, rails, or other guidance features.

The projectile 118 may comprise one or more abrasive materials. The abrasive materials may be arranged within or on the projectile 118 and configured provide an abrasive action upon impact with the working face of the geologic material 106. The abrasive materials may include diamond, garnet, silicon carbide, tungsten, or copper. For example, a middle core 507 may comprise an abrasive material that may be layered between the inner core and the outer core 508 of the rod penetrator 408.

Figure 6:
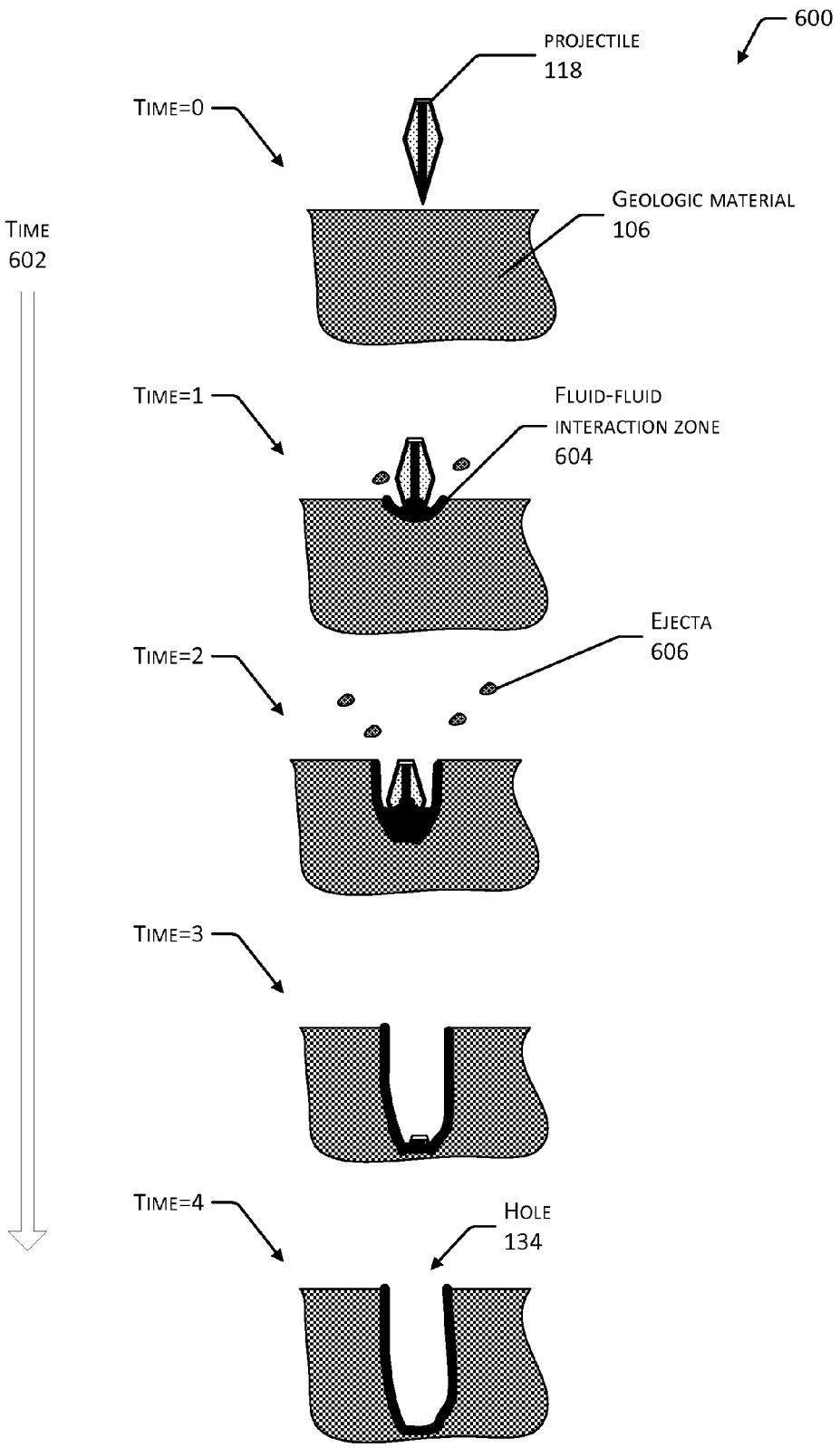
FIG. 6 illustrates a fluid-fluid impact interaction of the projectile with the geological material.

FIG. 6 illustrates a sequence 600 of a fluid-fluid impact interaction such as occurring during penetration of the working face of the geologic material 106 by the projectile 118 that has been ejected from the ram accelerator 102. In this illustration time 602 is indicated as increasing down the page, as indicated by an arrow.

In one implementation, a projectile 118 with a length to diameter ratio of approximately 10:1 or more is impacted at high velocity into the working surface of a geologic material 106. Penetration at a velocity above approximately 800 meters/sec results in a penetration depth that is on the order of two or more times the length of the projectile 118. Additionally, the diameter of the hole 134 created is approximately twice the diameter of the impacting projectile 118. Additional increases in velocity of the projectile 118 result in increases in penetration depth of the geologic material 106. As the velocity of the projectile 118 increases, the front of the projectile 118 starts to mushroom on impact with the working face of the geologic material 106. This impact produces a fluid-fluid interaction zone 604 which results in erosion or vaporization of the projectile 118. A back pressure resulting from the impact may force ejecta 606 or other material such as cuttings from the reamers from the hole 134. The ejecta 606 may comprise particles of various sizes ranging from a fine dust to chunks. In some implementations the ejecta 606 may comprise one or more materials which are useful in other industrial processes. For example, ejecta 606 which include carbon may comprise buckyballs or nanoparticles suitable for other applications such as medicine, chemical engineering, printing, and so forth.

The higher the velocity, the more fully eroded the projectile 118 becomes and therefore the "cleaner" or emptier the space created by the high-speed impact, leaving a larger diameter and a deeper hole 134. Also, the hole 134 will have none or almost no remaining material of the projectile 118, as the projectile 118 and a portion of the geologic material 106 has vaporized.

Figure 7:
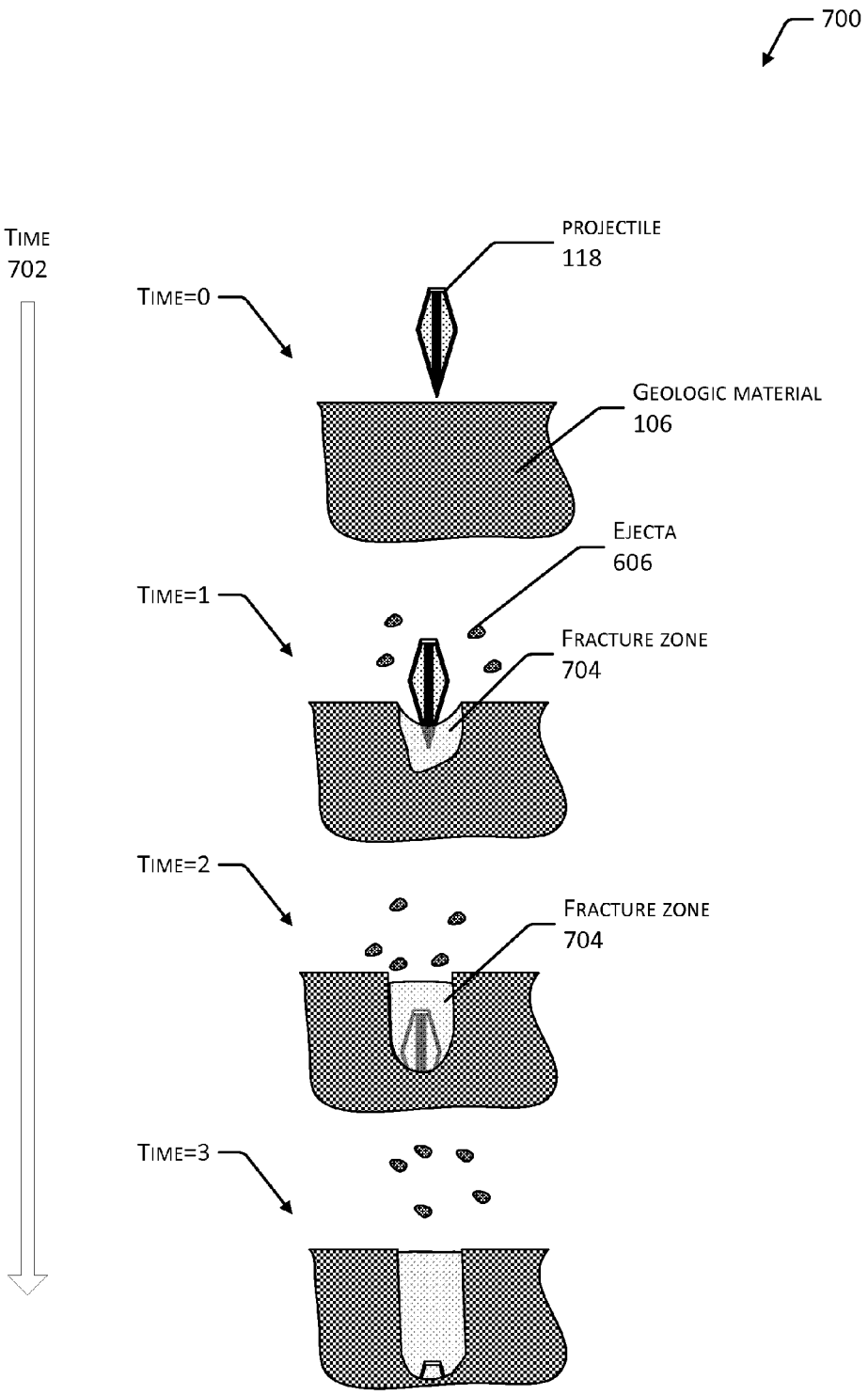
FIG. 7 illustrates a non-fluid-fluid impact interaction of the projectile with the geological material.

FIG. 7 illustrates a sequence 700 of a non-fluid-fluid interaction such as occurring during penetration of the working face of the geologic material 106 by the projectile 118 at lower velocities. In this illustration time 702 is indicated as increasing down the page, as indicated by an arrow.

At lower velocities, such as when the projectile 118 is ejected from the ram accelerator 102 at a velocity below 2 kilometers per second, the portion of the geologic material 106 proximate to the projectile 118 starts to fracture in a fracture zone 704. Ejecta 606 may be thrown from the impact site. Rather than vaporizing the projectile 118 and a portion of the geologic material 106 as occurs with the fluid-fluid interaction, here the impact may pulverize or fracture pieces of the geological material 106.

As described above, a back pressure resulting from the impact may force the ejecta 606 from the hole 134.

Figure 8:
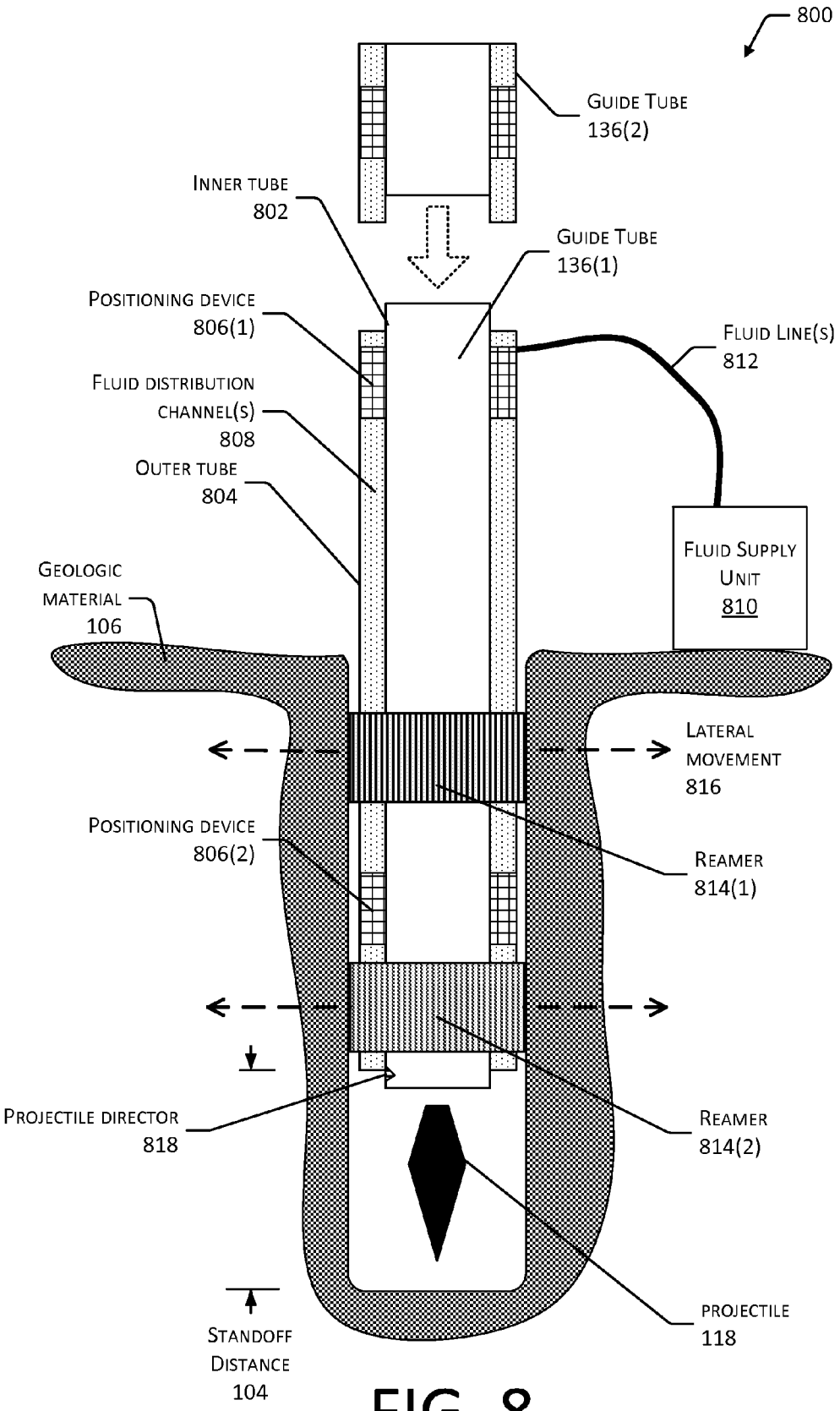
FIG. 8 illustrates additional detail associated with the guide tube, as well as reamers and other devices which may be placed downhole.

FIG. 8 illustrates a mechanism 800 including the guide tube 136 equipped with an inner tube 802 and an outer tube 804. Positioning of the inner tube 802 relative to the outer tube 804 may be maintained by one or more positioning devices 806. In some implementations the positioning device 806 may comprise a collar or ring. The positioning device 806 may include one or more apertures or pathways to allow materials such as fluid, ejecta 606, and so forth, to pass. The positioning device 806 may be configured to allow for relative movement between the inner tube 802 and the outer tube 804, such as rotation, translation, and so forth.

The space between the inner guide tube 802 and the outer guide tube 804 may form one or more fluid distribution channels 808. The fluid distribution channels 808 may be used to transport ejecta 606, fluids such as cooling or hydraulic fluid, lining materials, and so forth. The fluid distribution channels 808 are configured to accept fluid from a fluid supply unit 810 via one or more fluid lines 812. The fluid distribution channels 808 may comprise a coaxial arrangement of one tube within another, the jacket comprising the space between an inner tube and an outer tube. The fluid may be recirculated in a closed, or used once in an open loop.

The inner tube 802 is arranged within the outer tube 804. In some implementations the tubes may be collinear with one another. Additional tubes may be added, to provide for additional functionality, such as additional fluid distribution channels 808.

One or more reamers 814 are coupled to the fluid distribution channels 808 and arranged in the hole 134. The reamers 814 may be configured to provide various functions.

These functions may include providing a substantially uniform cross section of the hole 134 by cutting, scraping, grinding, and so forth. Another function provided by the reamer 814 may be to act as a bearing between the walls of the hole 134 and the guide tube 136. The fluid from the fluid supply unit 810 may be configured to cool, lubricate, and in some implementations power the reamers 814.

The reamers 814 may also be configured with one or more actuators or other mechanisms to produce one or more lateral movements 816. These lateral movements 816 displace at least a portion of the guide tube 136 relative to the wall of the hole 134, tilting, canting, or curving one or more portions of the guide tube 136. As a result, the impact point of the projectile 118 may be shifted. By selectively applying lateral movements 816 at one or more reamers 814 within the hole 134, the location of subsequent projectile 118 impacts and the resulting direction of the drilling path 138 may be altered. For example, the drilling path 138 may be curved as a result of the lateral movement 816.

The reamers 814, or other supporting mechanisms such as rollers, guides, collars, and so forth, may be positioned along the guide tube 136. These mechanisms may prevent or minimize Euler buckling of the guide tube 136 during operation.

In some implementations, a path of the projectile 118 may also be altered by other mechanisms, such as a projectile director 818. The projectile director 818 may be arranged at one or more locations, such as the guide tube 136, at an end of the guide tube 136 proximate to the working face of the geologic material 106, and so forth. The projectile director 818 may include a structure configured to deflect or shift the projectile 118 upon exit from the guide tube 136.

As described above, the guide tube 136, or the ram accelerator 102 when no guide tube is in use, may be separated from the working face of the geologic material 106 by the standoff distance 104. The standoff distance 104 may vary based at least in part on depth, material in the hole 134, firing parameters, and so forth. In some implementations the standoff distance 104 may be two or more feet.

As drilling progresses, additional sections of guide tube 136 may be coupled to those which are in the hole 134. As shown here, the guide tube 136(1) which is in the hole 134 may be coupled to a guide tube 136(2). In some implementations the inner tubes 802 and the outer tubes 804 may be joined in separate operations. For example, the inner tube 802(2) may be joined to the inner tube 802(1) in the hole 134, one or more positioning devices 806 may be emplaced, and the outer tube 804(2) may be joined also to the outer tube 804(1).

Figure 9:
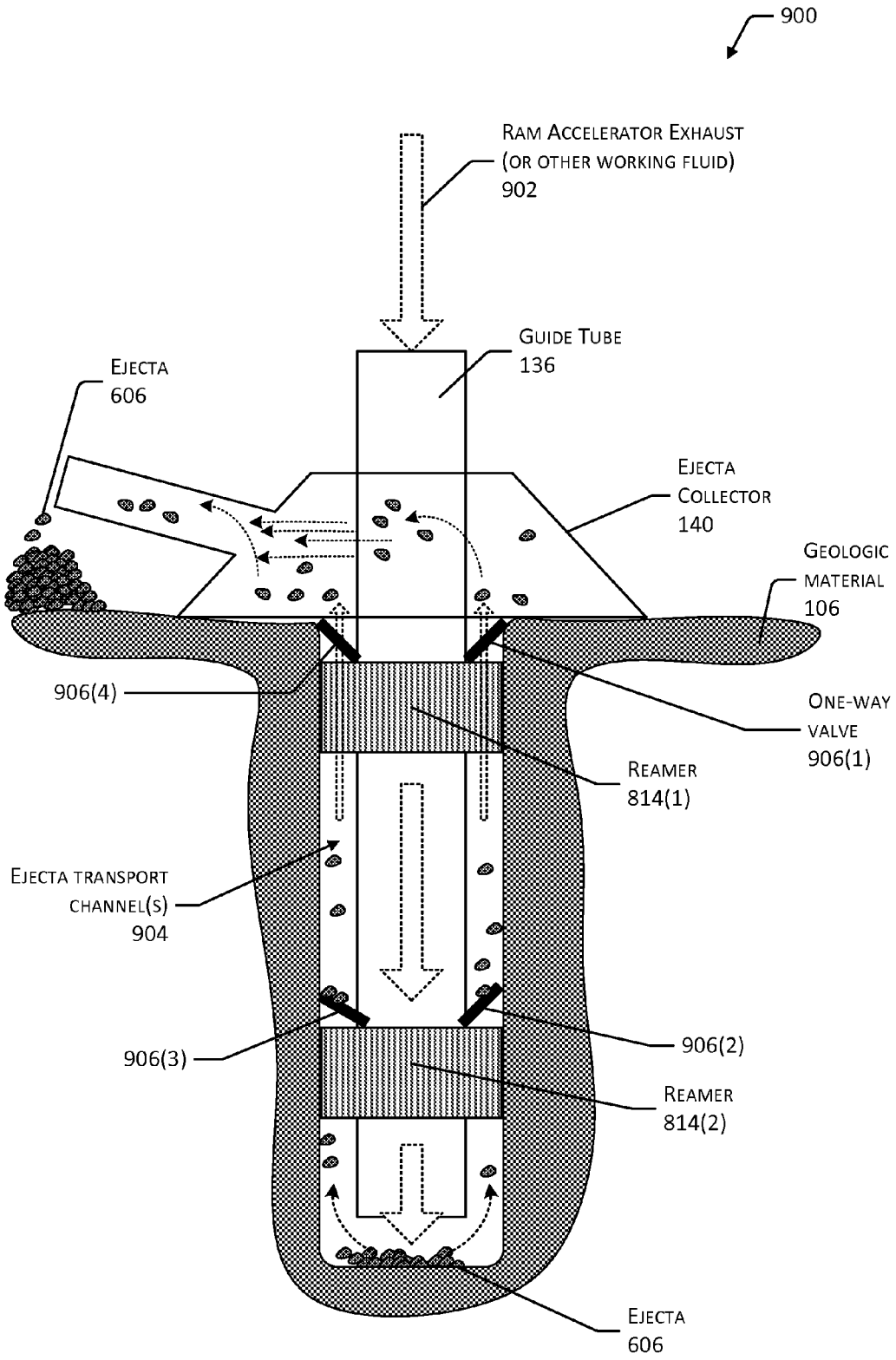
FIG. 9 illustrates a guide tube placed downhole having an ejecta collector coupled to one or more ejecta channels configured to convey ejecta from the impact aboveground for disposal.

FIG. 9 illustrates a mechanism 900 in which a fluid such as exhaust from the firing of the ram accelerator 102 is used to drive ejecta 606 or other material such as cuttings from the reamers 814 from the hole 134. In this illustration, the guide tube 136 is depicted with the one or more reamers 814. The fluid distribution channels 808 or other mechanisms described herein may also be used in conjunction with the mechanism 900.

Ram accelerator exhaust 902 ("exhaust") or another working fluid is forced down the guide tube 136. The working fluid may include air or other gasses, water or other fluids, slurries, and so forth under pressure. The exhaust 902 pushes ejecta 606 into one or more ejecta transport channels 904. In one implementation, the ejecta transport channels 904 may comprise a space between the guide tube 136 and the walls of the hole 134. In another implementation the ejecta transport channels 904 may comprise a space between the guide tube 136 and another tube coaxial with the guide tube 136. The ejecta transport channels 904 are configured to carry the ejecta 606 from the hole 134 out to the ejecta collector 140.

A series of one-way valves 906 may be arranged within the ejecta transport channels 904. The one-way valves 906 are configured such that the exhaust 902 and the ejecta 606 are able to migrate away from a distal end of the hole 134, towards the ejecta collector 140. For example, a pressure wave produced by the projectile 118 travelling down the guide tube 136 forces the ejecta 606 along the ejecta transport channels 904, past the one-way valves 906. As the pressure subsides, larger pieces of ejecta 606 may fall, but are prevented from returning to the end of the hole 134 by the one-way valves 906. With each successive pressure wave resulting from the exhaust 902 of successive projectiles 118 or other injections or another working fluid, the given pieces of ejecta 606 migrate past successive one-way valves 906 to the surface. At the surface, the ejecta collector 140 transports the ejecta 606 for disposal.

The ejecta 606 at the surface may be analyzed to determine composition of the geologic material 106 in the hole 134. In some implementations, the projectile 118 may be configured with a predetermined element or tracing material, such that analysis may be associated with one or more particular projectiles 118. For example, coded taggants may be injected into the exhaust 902, placed on or within the projectile 118, and so forth.

Figure 10:
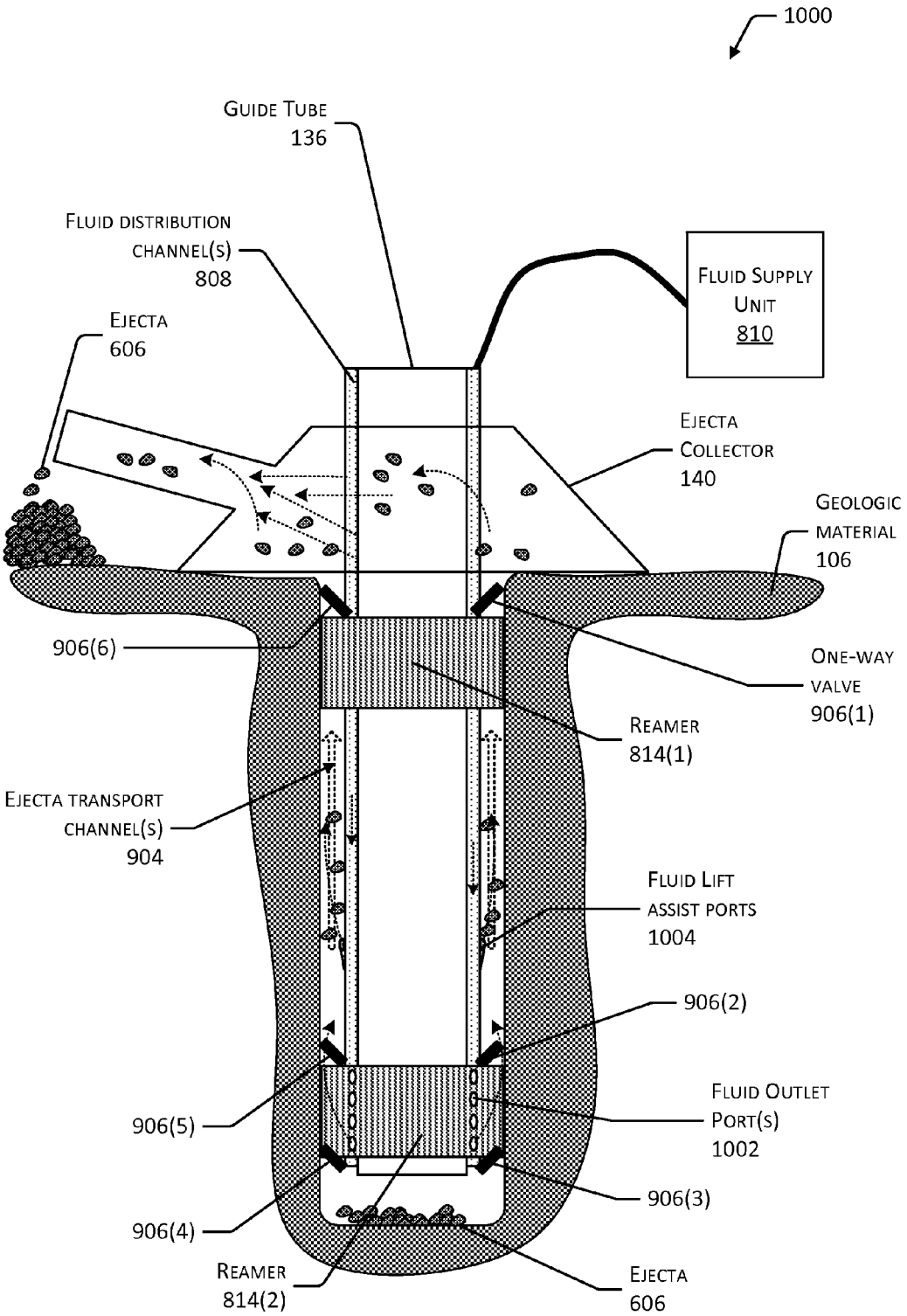
FIG. 10 illustrates a guide tube placed downhole having a reamer configured to be cooled by a fluid which is circulated aboveground to remove at least a portion of the ejecta.

FIG. 10 illustrates a mechanism 1000 for using fluid to operate the reamers 814 or other devices in the hole 134 and remove ejecta 606. As described above, the guide tube 136 may be equipped with one or more fluid distribution channels 808. The fluid distribution channels 808 may be configured to provide fluid from the fluid supply unit 810 to one or more devices or outlets in the hole 134.

In this illustration, one or more of the reamers 814 are configured to include one or more fluid outlet ports 1002. The fluid outlet ports 1002 are configured to emit at least a portion of the fluid from the fluid distribution channels 808 into the hole 134. This fluid may be used to carry away ejecta 606 or other material such as cuttings from the reamers 814. As described above, a series of one-way valves 906 are configured to direct the ejecta 606 or other debris towards the ejecta collector 140. In some implementations, fluid lift assist ports 1004 may be arranged periodically along the fluid distribution channels 808. The fluid lift assist ports 1004 may be configured to assist the movement of the ejecta 606 or other debris towards the ejecta collector 140 by providing a jet of pressurized fluid. The fluid outlet ports 1002, the fluid lift assist ports 1004, or both may be metered to provide a fixed or adjustable flow rate.

The motion of the fluid containing the ejecta 606 or other debris from the fluid outlet ports 1002 and the fluid lift assist ports 1004 may work in conjunction with pressure from the exhaust 902 to clear the hole 134 of ejecta 606 or other debris. In some implementations various combinations of projectile 118 may be used to pre-blast or clear the hole 134 of debris prior to firing of a particular projectile 118.

As described above, the ram accelerator 102 may work in conjunction with conventional drilling techniques. In one implementation, the end of the guide tube 136 in the hole 134 may be equipped with a cutting or guiding bit. For example, a coring bit may allow for core sampling.

Figure 11:
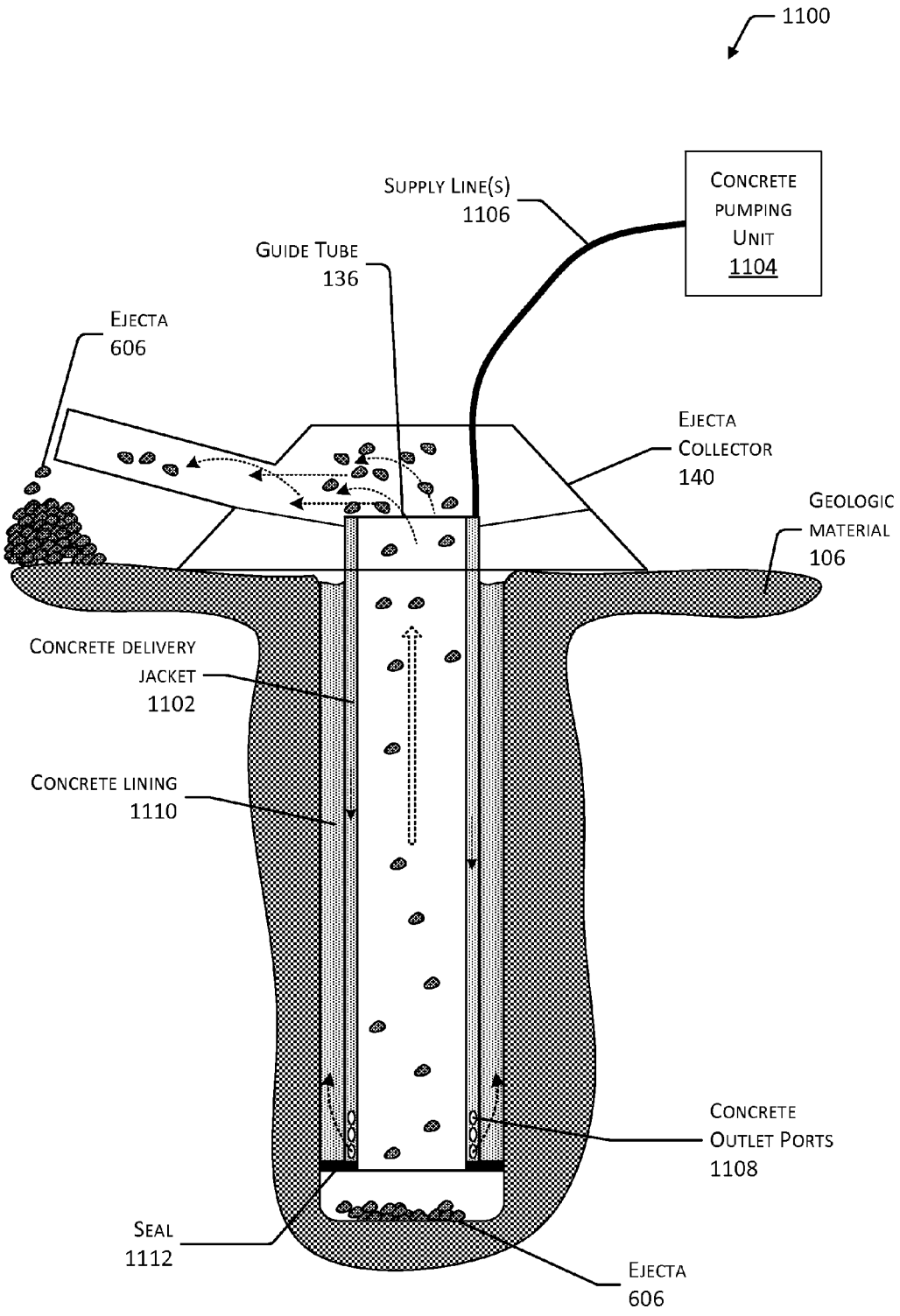
FIG. 11 illustrates a guide tube placed downhole deploying a continuous concrete lining within the hole.

FIG. 11 illustrates a mechanism 1100 in which a lining is deployed within the hole 134. A concrete delivery jacket 1102 or other mechanism such as piping is configured to accept concrete from a concrete pumping unit 1104 via one or more supply lines 1106. The concrete flows through the concrete delivery jacket 1102 to one or more concrete outlet ports 1108 within the hole 134. The concrete is configured to fill the space between the walls of the hole 134 and the guide tube 136. Instead of, or in addition to concrete, other materials such as Bentonite, agricultural straw, cotton, thickening agents such as guar gum, xanthan gum, and so forth may be used.

As drilling continues, such as from successive impacts of projectile 118 fired by the ram accelerator 102, the guide tube 136 may be inserted further down into the hole 134, and the concrete may continue to be pumped and extruded from the concrete outlet ports 1108, forming a concrete lining 1110. In other implementations, material other than concrete may be used to provide the lining of the hole 134.

In some implementations, a seal 1112 may be provided to minimize or prevent flow of concrete into the working face of the hole 134 where the projectiles 118 are targeted to impact. The mechanisms 1100 may be combined with the other mechanisms described herein, such as the reamer mechanisms 800, the ejecta 606 removal mechanisms 900 and 1000, and so forth.

In one implementation the concrete may include a release agent or lubricant. The release agent may be configured to ease motion of the guide tube 136 relative to the concrete lining 1110. In another implementation, a release agent may be emitted from another set of outlet ports. A mechanism may also be provided which is configured to deploy a disposable plastic layer between the guide tube 136 and the concrete lining 1110. This layer may be deployed as a liquid or a solid. For example, the plastic layer may comprise polytetrafluoroethylene ("PTFE"), polyethylene, and so forth.

In some implementations a bit or other cutting tool may be affixed to a tip of the guide tube 136. For example, a tri-cone drill may be affixed to an end of the guide tube 136. The cutting tool may have an aperture through which the projectile 118 may pass and impact the working face. The cutting tool may be in operating during impact, or may be idle during impact.

Figure 12:
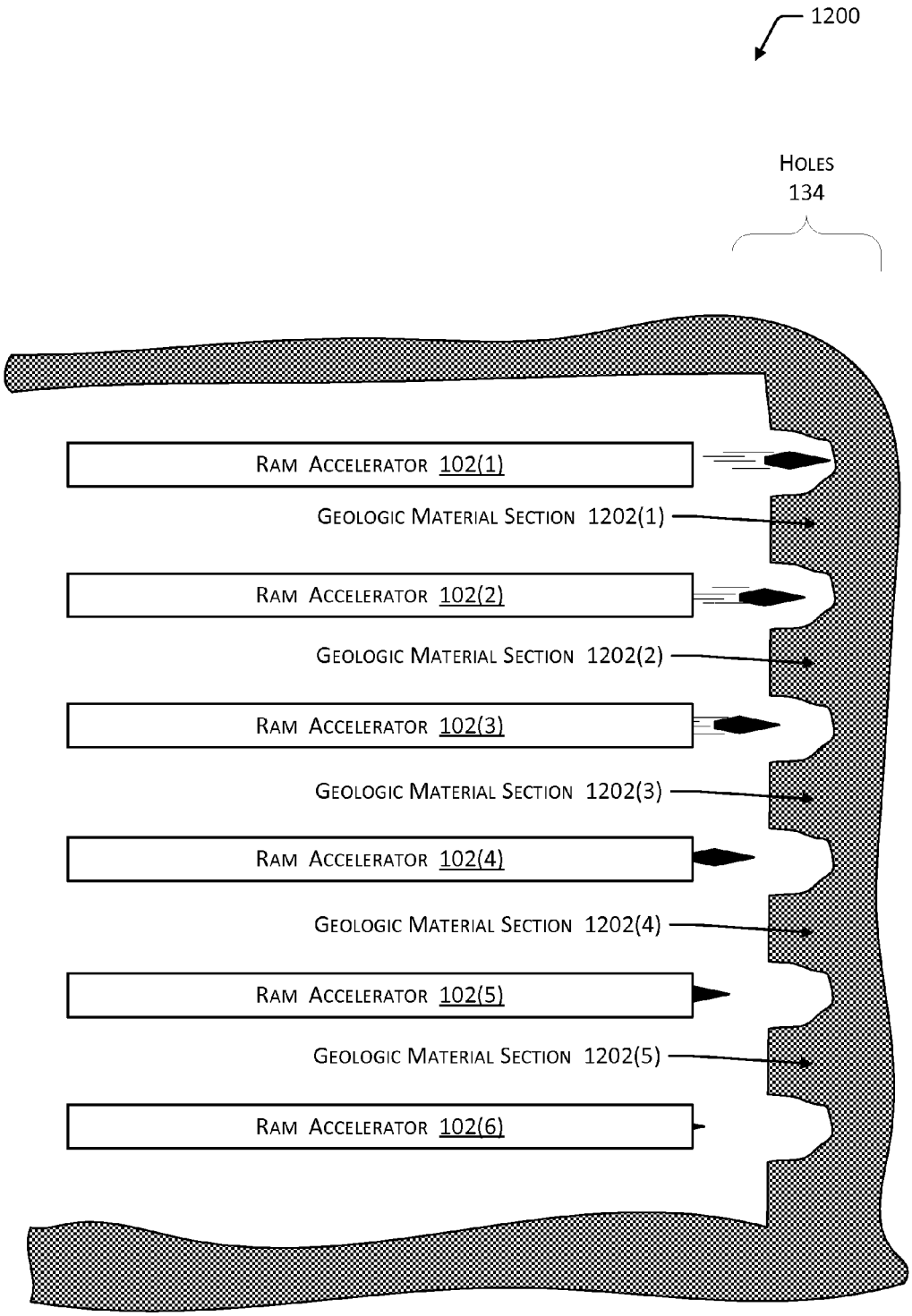
FIG. 12 illustrates tunnel boring or excavation using a ram accelerator to drill a plurality of holes using a plurality of projectiles.

FIG. 12 illustrates a mechanism 1200 for tunnel boring or excavation using one or more ram accelerators 102. A plurality of ram accelerators 102(1)-(N) may be fired sequentially or simultaneously to strike one or more target points on the working face, forming a plurality of holes 134. The impacts may be configured in a predetermined pattern which generates one or more focused shock waves within a geologic material 106. These shock waves may be configured to break or displace the geologic material 106 which is not vaporized on impact.

As shown here, six ram accelerators 102(1)-(6) are arranged in front of the working face. One or more projectiles 118 are launched from each of the ram accelerators 102, forming corresponding holes 134(1)-(6). The plurality of ram accelerators 102(1)-(N) may be moved in translation, rotation, or both, either as a group or independently, to target and drill the plurality of holes 134 in the working face of the geologic material 106.

In another implementation, a single ram accelerator 102 may be moved in translation, rotation, or both, to target and drill the plurality of holes 134 in the working face of the geologic material 106.

After the holes 134 are formed from impacts of the projectiles 118, various techniques may be used to remove pieces or sections of geologic material 106. The sections of geologic material 1202 are portions of the geologic material 106 which are defined by two or more holes which are proximate to one another. For example, four holes 134 arranged in a square define a section of the geologic material 106 which may be removed, as described below with regard to FIG. 13.

As described above, use of the ram accelerated projectile 118 allows for rapid formation of the holes 134 in the geologic material 106. This may result in reduced time and cost associated with tunnel boring.

Figure 13:
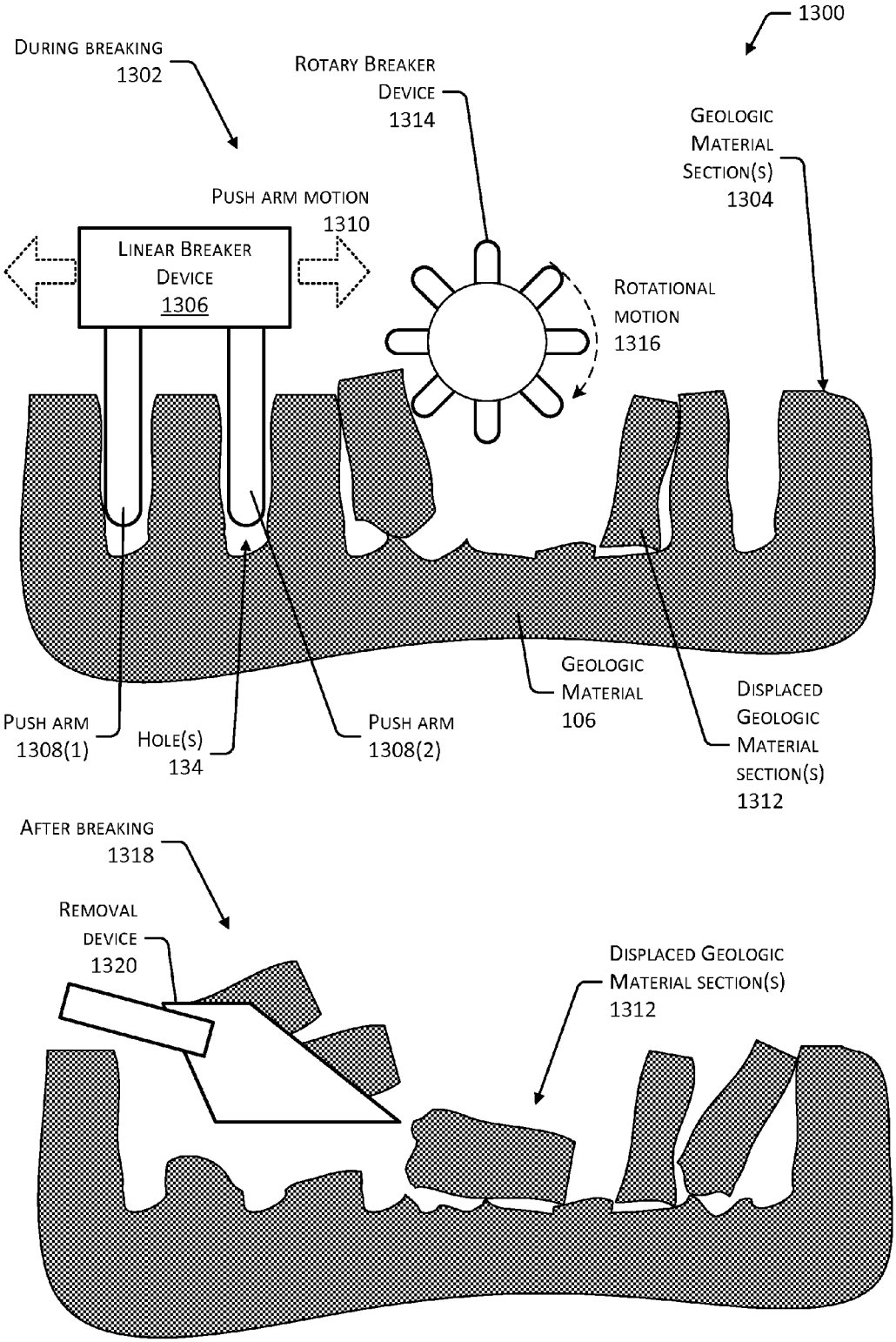
FIG. 13 illustrates devices to remove rock sections defined by holes drilled by the ram accelerator projectiles.

FIG. 13 illustrates devices and processes 1300 to remove rock sections defined by holes drilled by the ram accelerator projectiles 118 or conventional drilling techniques. During breaking 1302, the ram accelerator 102 may include a mechanism which breaks apart the geologic material sections 1304. For example, the ram accelerator 102 may comprise a linear breaker device 1306 that includes one or more push-arms 1308 that move according to a push-arm motion 1310. The push-arms 1308 may be inserted between the geologic material sections 1304 and mechanical force may be applied by push arms 1308 to snap, break, or otherwise free pieces of the geologic material 106 from a main body of the geologic material 106 at the working face, forming displaced geologic material sections 1312.

In some implementations a rotary breaker device 1314 that moves according to the rotary motion 1316 may be used instead of, or in addition to, the linear breaker device 1306. The rotary breaker device 1314 breaks apart the geologic material sections 1304 by applying mechanical force during rotation. After breaking 1318, a removal device 1320 transports the displaced geologic material sections 1312 from the hole 134. For example, the removal device 1320 may comprise a bucket loader.

Figure 14:
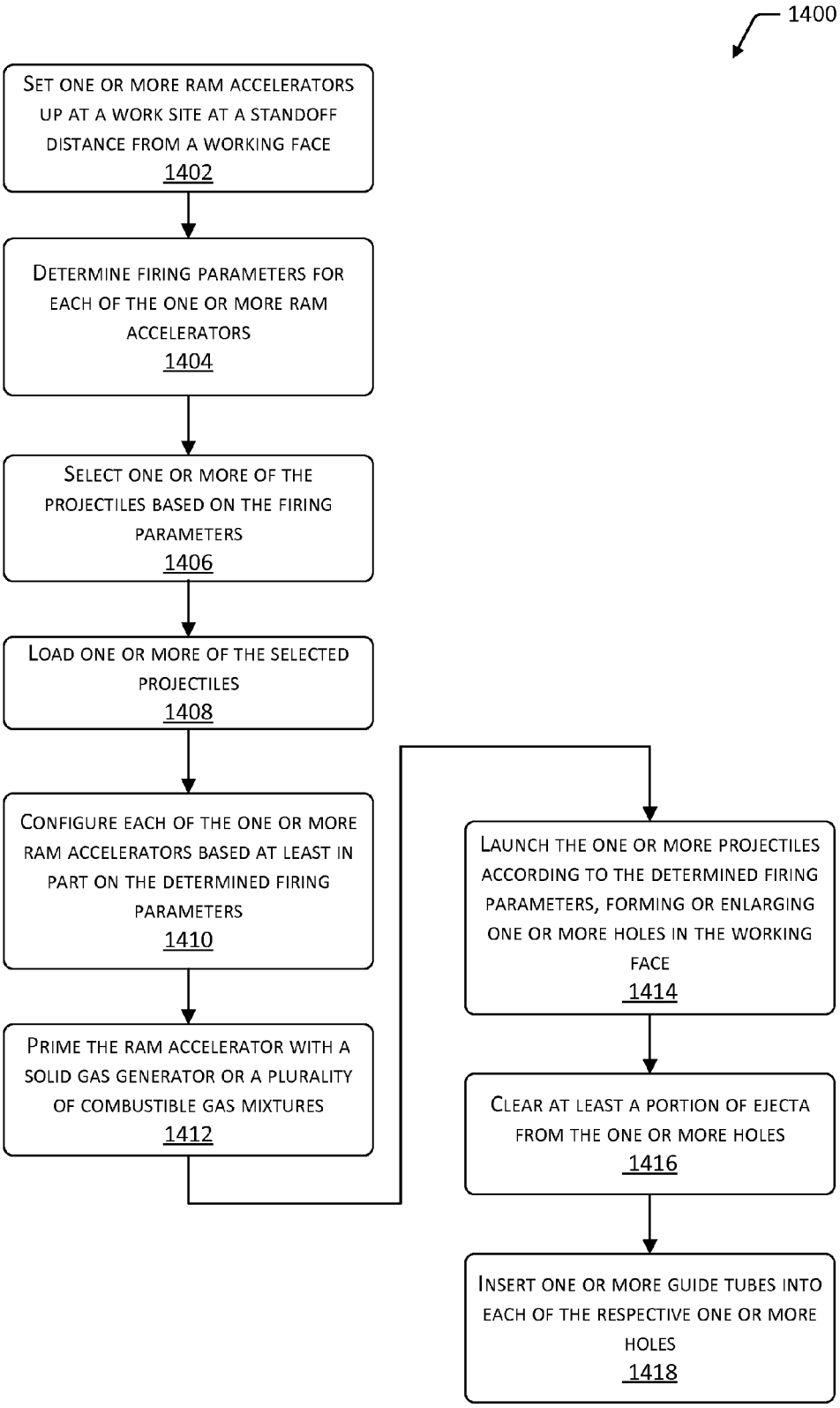
FIG. 14 is a flow diagram of a process of drilling a hole using a ram accelerator.

FIG. 14 is flow diagram 1400 of an illustrative process 1400 of penetrating geologic material 106 utilizing a hyper velocity ram accelerator 102. At block 1402, one or more ram accelerators 102 are set up at a work site 202 to drill several holes for tunnel boring, excavation, and so forth. The ram accelerators 102 may be positioned vertically, horizontally, or diagonally at a stand-off distance from the working face of the geologic material 106 to be penetrated.

At block 1404, once the ram accelerators 102 are positioned, the firing parameters, such as for example, projectile 118 type and composition, hardness and density of the geologic material 106, number of stages in the respective ram accelerator, firing angle as well as other ambient conditions including air pressure, temperature, for each of the ram accelerators 102 is determined. At block 1406, upon a determination of the firing parameters one or more projectiles 118 is selected based at least in part on the firing parameters and the selected one or more projectiles 118 is loaded into the ram accelerator 102 as described at block 1408.

At block 1410, each of the ram accelerators 102 is configured based at least in part on the determined firing parameters. At block 1412, each of the ram accelerators 102 is then primed with either a solid gas generator or a plurality of combustible gas mixtures. After priming the one or more ram accelerators 102, at 1414 one or more of the loaded projectiles 118 is launched according to the determined firing parameters. For example, a projectile 118 is boosted to a ram velocity down the launch tube 116 and through the multiple sections and ejected from the ram accelerator 102 forming or enlarging one or more holes 134 in the working face of the geologic material 106.

At 1416 at least a portion of the ejecta 606 is cleared from the one or more holes 134 in the working face of the geologic material 106. As described above, a back pressure resulting from the impact may force the ejecta 606 from the hole 134. In some implementations a working fluid such as compressed air, water, and so forth may be injected into the hole 134 to aid in removal of at least a portion of the ejecta 606. Each of the holes 134 formed by the impact of the projectile 118 at hypervelocity may be further processed. At block, 1418, a guide tube 136 may be inserted into the hole 134 to prevent subsidence, deploy instrumentation, and so forth. In one implementation, a reamer 814 coupled to a guide tube 136 may be inserted down the hole 134 and configured to provide a substantially uniform cross section.

Figure 15:
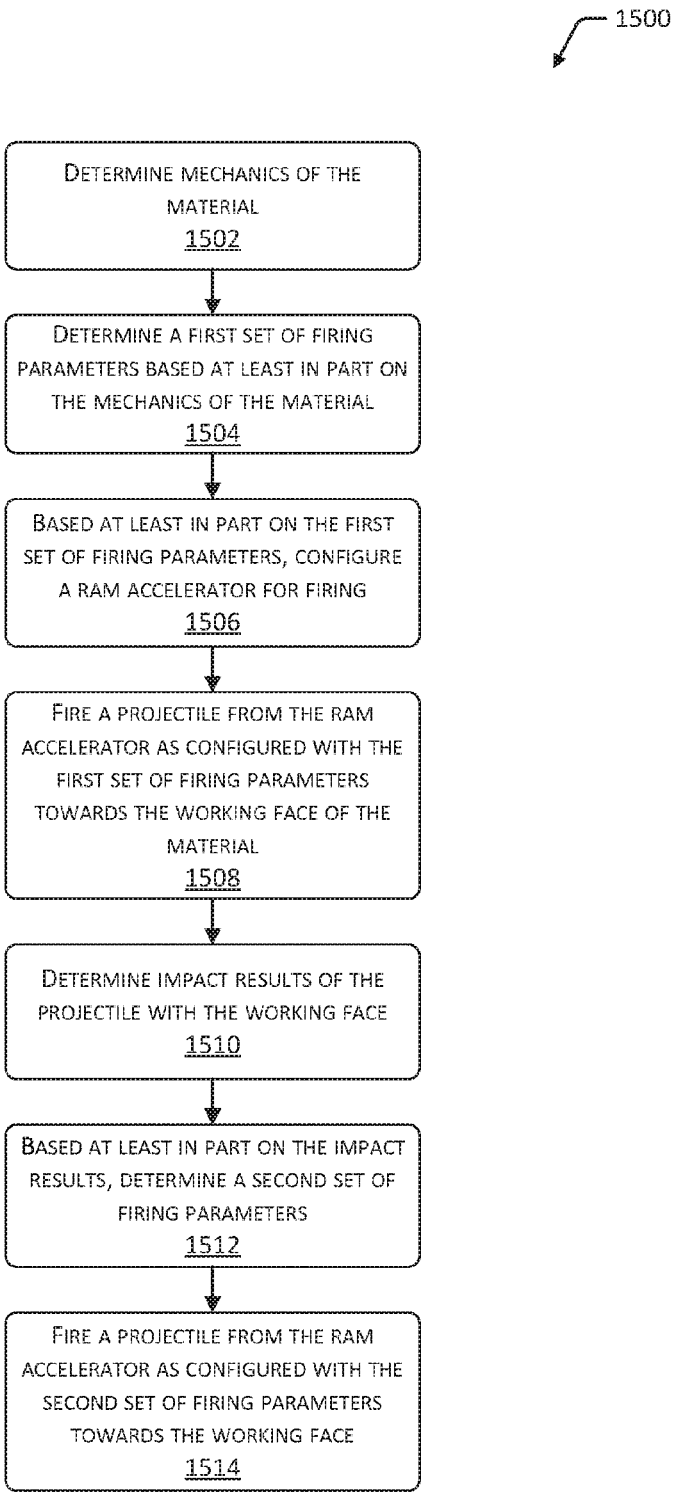
FIG. 15 is a flow diagram of a process of multiple firings of a plurality of projectiles with firing patterns adjusted between at least some of the firings.

FIG. 15 is an illustrative process 1500 of penetrating geologic material 106 utilizing a hyper velocity ram accelerator 102 to fire multiple projectiles 118 down a single hole 134 such that the hole 134 is enlarged as subsequent projectile 118 penetrate deeper into the geologic material 106. At block 1502, the mechanics of the geologic material 106 is determined. At block 1504, an initial set of firing parameters is determined based at least in part on the mechanics of the geologic material 106. At block 1506, the ram accelerator 102 is configured for firing based at least in part on the initial set of firing parameters. Once the ram accelerator 102 is configured, at block 1508, the projectile 118 is fired toward the working face of the geologic material 106 forming one or more holes 134. At block 1510, the impact results of the projectile 118 with the working face are determined. In some embodiments, the ram accelerator 102 may need to be reconfigured before loading and firing a subsequent projectile 118 into the hole 134. At block 1512, a second of firing parameters is determined based at least in part on the impact results. At block 1514, a subsequent projectile 118 is fired from the ram accelerator 102 as configured with the second set of firing parameters towards the working face of the geologic material 106. This process may be repeated until the desired penetration depth is reached.

Figure 16:
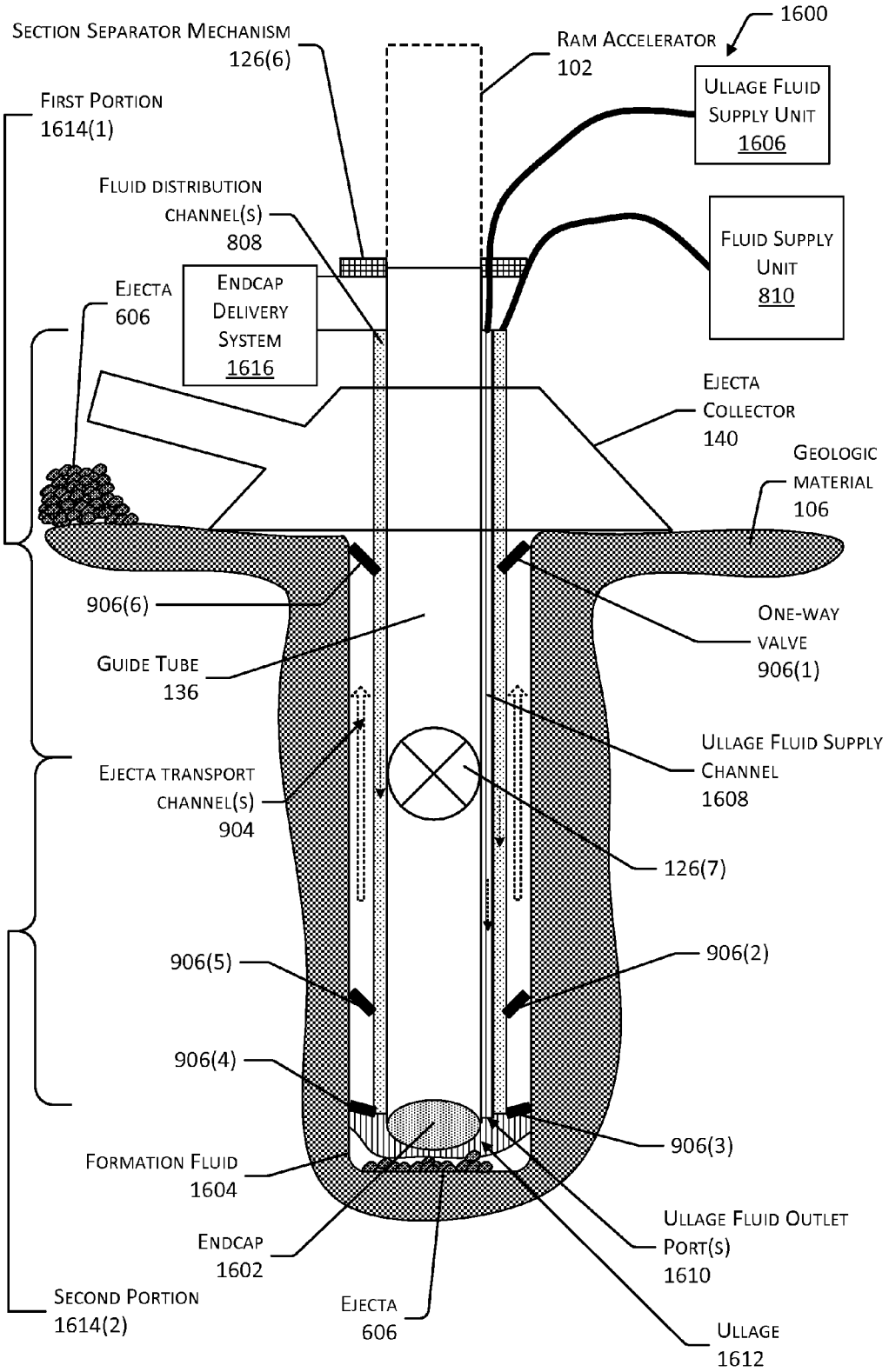
FIG. 16 illustrates a guide tube placed downhole with an endcap deployed and a system for creating a ullage in formation fluid in the hole.

FIG. 16 illustrates a mechanism 1600 comprising a guide tube placed downhole with an endcap 1602 deployed and a system for creating a ullage in formation fluid in the hole. In this illustration the guide tube 136 is depicted. However, in other implementations the mechanisms described may be used in conjunction with a drift tube. An endcap 1602 may be placed within the guide tube 136 to provide at least a partial seal between an interior of the guide tube 136 down which the projectile 118 may pass and a formation fluid 1604 which may accumulate at the working face within the hole 134. For example, the formation fluid 1604 may include drilling mud, oil, water, mud, gas, and so forth.

In one implementation, the endcap 1602 may be deployed to an end of the guide tube 136 which is proximate to the working face. The endcap 1602 may form at least a partial seal, preventing or impeding flow of the formation fluid 1604 into the portion of the guide tube 136 within which the projectile 118 travels.

A ullage fluid supply unit 1606 is configured to provide a ullage fluid or purge gas by way of one or more ullage fluid supply channels 1608 to one or more ullage fluid outlet ports 1610 which are proximate to the working face. The ullage fluid may comprise a gas or a liquid. Gas ullage fluids may include, but are not limited to, helium, hydrogen carbon dioxide, nitrogen, and so forth. In some implementations the ullage fluid may be combustible or detonable, such as the combustible gas mixture 128 described above.

The ullage fluid may be injected into a volume which is bounded at least in part by the endcap 1602 and the working face. The ullage fluid may be applied at a pressure which is equal to or greater than the pressure of the surrounding formation fluid 1604. The ullage fluid is injected to form a ullage 1612, or pocket within the formation fluid 1604. For example, where the ullage fluid comprises a gas, the ullage 1612 comprises a space which is occupied by the gas, displacing at least some of the formation fluid 1604. This displacement may reduce or prevent the incursion of the formation fluid 1604 or components thereof from the hole 134. The pocket may occupy the entire volume between the proximate portion of the drilling equipment and the working face, or a portion thereof. The ullage 1612 provides a compressible volume within which pieces of ejecta 606 and other impact products may be dispersed, at least temporarily.

In one implementation, the ullage fluid may be applied in a transient or "burp" mode, generating the ullage 1612 for a brief period of time. While the ullage 1612 is in existence, the ram accelerator 102 may be configured to fire the projectile 118 through the endcap 1602, the ullage 1612, and into the working face.

In some implementations, the ram accelerator 102 may utilize a baffle-tube ram accelerator configuration, also known as a "baffled-tube" ram accelerator. The baffled-tube ram accelerator may comprise a series of baffles or annular rings configured to control displacement of the combustible gas mixture 128 during passage of the projectile 118. The baffled-tube ram accelerator may be used instead of, or in addition to the section separator mechanism 126 described above.

In one implementation the endcap 1602 may provide the ullage 1612, displacing at least a portion of the formation fluid 1604. The endcap 1602 may comprise a foam, expanded matrix, balloon, structure which is configured to expand and maintain a seal with the guide tube 136, and so forth. In some implementations the endcap 1602 may comprise a combustible material. The endcap 1602 may be configured to come into contact with the working face, such as the ejecta 606, or may be separated from the working face by the formation fluid 1604 prior to creation of the ullage 1612.

In some implementations, a plurality of endcaps 1602 may be employed within the guide tube 136, within the ram accelerator 102, and so forth. For example, endcaps 1602 may be configured to perform one or more functions similar to, or the same as, the section separator mechanism 126.

In some implementations instead of applying ullage fluid to create the ullage 1612, a chemical or pyrotechnic device may be used. For example, pyrotechnic gas generator charges may be deployed and configured to generate gas, forming the ullage 1612 in the formation fluid 1604. In another example, a chemical gas generator may be configured to emit a gas upon contact with a reactant, such as a component of the formation fluid 1604.

The projectile 118 may be configured to generate the ullage fluid. For example, the tip of the projectile 118 may be configured to vaporize and emit a gas, such that the ullage is formed 1612.

The control system 144 may coordinate operation of one or more of the ram accelerator 102, the fluid supply unit 810, or the ullage fluid supply unit 1606. For example, the control system 144 may be configured to provide a surge or temporary increase in pressure to the fluid being distributed down the hole 134 prior to or during firing of the ram accelerator 102. Similarly, the ullage fluid supply unit 1606 may be configured to provide the ullage fluid to form the ullage 1612 prior to impact of the projectile 118.

In some implementations the guide tube 136 or portion of ram accelerator 102 that is within the hole 134 may include one or more section separator mechanisms 126. For example, a section separator mechanism 126(7) in the guide tube 136 separates the guide tube 136 into a first portion 1614(1) and a second portion 1614(2). The section separator mechanism 126(7) may be opened or otherwise configured to allow the projectile 118 to pass down to the working face at the end of the hole 134.

An endcap delivery system 1616 is configured to deliver one or more endcap 1602 into the guide tube 136 such that they are proximate to an end of the guide tube 136 that is proximate to the working face. In one implementation, the endcap delivery system 1616 may be configured to insert an endcap 1602 into the interior of the guide tube 136, such as into the first portion 1614(1) of the guide tube 134, such as through an access port or other passageway. The section separator mechanism 126(7) may be opened or otherwise configured to permit the endcap 1602 to pass through to the second portion 1614(2) of the guide tube 136. During firing of the ram accelerator 102 the access port between the endcap delivery system 1616 and the guide tube 136 may be closed.

The endcap 1602 is configured to provide a barrier between a portion of the guide tube 136 and the geologic material 106 being drilled. This barrier provides a separation between an interior of the guide tube 136 and an environment external to the guide tube 136. The endcap 1602 may be held in place using one or more of hydraulic or pneumatic pressure, mechanical retaining devices (such as teeth or prongs), and so forth. For example, the guide tube 136 may be narrowed or constricted, such as by one or more rings or other features, at the end proximate to the working face. This constriction may retain the endcap 1602 at the end of the guide tube 136. In another implementation, moveable mechanical arms or other features may lock and hold the endcap 1602 in place.

The endcap 1602 may also maintain a pressure differential across the endcap 1602. For example, the guide tube 136 may be maintained at a first pressure while the volume exterior to the guide tube 136, such as the formation fluid 1604, may be at a second pressure that is different from the first pressure. In some implementations the endcap 1602 itself may be a pressurized value that may be at a third pressure different from the first and second pressures.

The endcap 1602 may be constructed of one or more of: a plastic, a polymer, a ceramic, an elastomer, a metal, or a composite material. The endcap 1602 may comprise a rigid structure, semi-rigid structure, flexible structure, or a combination thereof. For example, the endcap 1602 may comprise an expandable frame covered by a plastic or metal shell. In another example, the endcap 1602 may comprise an inflatable structure, such as a balloon. The structure of the endcap 1602 may be configured to maintain the barrier between the guide tube 136 interior and the external environment in the hole, but is permeable by the projectile 118.

The endcap 1602 may be positioned at the downhole end of the guide tube 136 using one or more techniques. One or more of the following implementations may be used to position the endcap 1602. In a first implementation, the endcap 1602 may be pulled by gravity to the bottom of the guide tube 136. For example, the endcap 1602 may sink to the bottom of the guide tube 136. In a second implementation, the endcap delivery system 1616 may use hydraulic or pneumatic pressure to displace the endcap 1602. For example, a pressured gas (such as the one or more combustible gasses) may be injected into the guide tube 136 to exert a pressure on the endcap 1602. This pressure may displace the endcap 1602 towards the end of the guide tube 136 proximate to the geologic material 106. The one or more combustible gasses may be used to fuel the projectile 118 during operation, or may be ignited to provide an increase in pressure within a portion of the guide tube 136 and displace the endcap 1602. In a third implementation a negative pressure may be applied at the end of the guide tube 136 proximate to the geologic material 106. For example, the formation fluid 1604 may be withdrawn using suction pumps to a pressure differential in a fluid. A force on the endcap 1602 resulting from the pressure differential may displace the endcap 136 proximate to the end of the guide tube 136 near the working face. In a fourth implementation, a mechanical member such as a pusher arm, rail system, and so forth, may be used to apply a mechanical pressure that displaced the endcap 1602. For example, the mechanical member may comprise an arm or rod that pushes the endcap 1602 down the guide tube 136 and into the desired position.

In some implementations before accelerating the projectile, an incombustible gas may be injected between the ram accelerator 102 and the working face of the geologic material 106. For example, an inert gas such as carbon dioxide or nitrogen may be injected into the guide tube 136 at a pressure that is greater than or equal to a pressure of the formation fluid 1604. At some depths, this may include a pressure greater than 6000 kilopascals. This operation may be performed by the ullage fluid supply unit 1606 to form a pocket of gas, the ullage 1612, at the end of the guide tube 136 before placing the endcap 1602. The endcap 1602 may subsequently be placed to form a barrier between the formation fluid 1604 or other debris and the guide tube 136.

In one implementation the ullage 1612 may be formed prior to placement of the endcap 1602. For example, the ullage 1612 may be formed and the endcap 1602 may be emplaced. In another implementation the endcap 1602 may be placed, and the ullage 1612 may then be formed. Combinations these processes may be combined. For example, the ullage 1612 may be formed or maintained prior to emplacement of the endcap 1602 as well as after emplacement of the endcap 1602 and before firing.

During firing, the section separator mechanism 126(7) may be opened or otherwise configured to allow the projectile 118 to pass. After passage of the projectile 118, the section separator mechanism 126(7) may be closed or otherwise provide a seal or other barrier between the first portion 1614(1) and the second portion 1614(2) of the guide tube 136. This may prevent incursion of formation fluid, ejecta 606, or other materials from entering the portion of the guide tube 136 between the section separator mechanism 126(7) and the ram accelerator 102.

In some implementations the endcap 1602 may be dislodged from the guide tube 136 or may be destroyed prior to passage of the projectile 118. For example, a shockwave preceding the projectile 118 may destroy the projectile 118 before the projectile 118 reaches the endcap 1602.

In some implementations an auger or other mechanism may be provided which is configured to remove ejecta 606 from the volume proximate to the working face. For example, the end of the guide tube 136 may have one or more auger blades affixed such that rotation moves the ejecta 606 away from the working face and into the ejecta transport channels 904.

Figure 17:
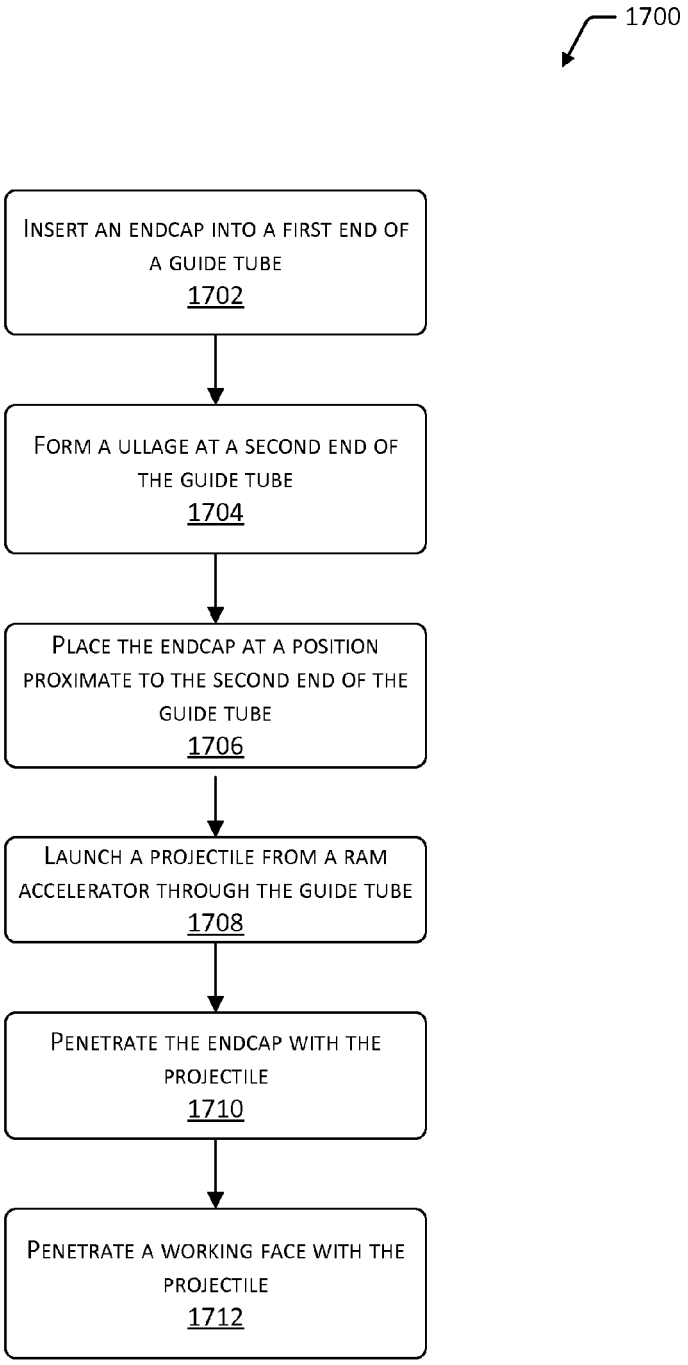
FIG. 17 is a flow diagram of a process of utilizing an endcap.

FIG. 17 is a flow diagram 1700 of a process of utilizing an endcap 1602 in conjunction with the ram accelerator 102 to drill one or more holes.

Block 1702 inserts and endcap 1602 into a first end of the guide tube 136. The first end of the guide tube 136 may be proximate the ram accelerator 102, wall the second end of guide to 136 may be at the opposing end within the whole proximate to the working face. In one implementation, the endcap delivery system 1616 may insert the endcap 1602 through an access port into the interior of the guide tube 136. In some implementations, the endcap delivery system 1616 may operate to displace the endcap 1602 proximate to the end of the guide tube 136 that is close to the working face, such as at the bottom of the hole. For example, the endcap delivery system 1616 may utilize a pressurized gas, combustion, mechanical member, or other mechanism to position the endcap 1602 at the bottom of the guide tube 136.

In some implementations, prior to placement of the endcap 1602, block 1704 may form a ullage 1612 or pocket. This displaces the formation fluid 1604 away from the end of the guide tube 136.

Block 1706 places the endcap 1602 at a position proximate to the second end of the guide 136. The endcap 1602 may be retained in this position by one or more of friction with the interior walls of guide to 136, one or more mechanical members, continued pressure applied by the endcap delivery system 1616, and so forth.

Block 1708 launches a projectile 118 from the ram accelerator 102 through the guide tube 136. Prior to or contemporaneously with the launch, one or more of the section separator mechanisms 126 may be configured to allow for passage of the projectile 118. In some implementations, prior to or contemporaneously with the launch of the projectile 118, the ullage fluid supply unit 1606 may form a ullage 1612 in the formation fluid 1604 between the endcap 1602 and the working face.

Block 1710 penetrates the endcap 1602 with the projectile 118. In some implementations, the endcap 1602 may be destroyed prior to penetration by the projectile 118. For example a shockwave or other phenomena may damage or destroy the endcap 1602 before it is reached by the projectile 118. Until the penetration or destruction of the endcap 1602, the endcap 618 provided a barrier between the formation fluid 1604, ejecta 606, or other materials that were external to the guide tube 136.

Block 1712 penetrates the working face with the projectile 118. Following penetration, one or more of the section separator mechanisms 126 in the guide tube 136, ram accelerator 102, or both may be closed. Another endcap 1602 may be deployed by the endcap delivery system 1616, and the process may continue. In some implementations, the endcap delivery system 1616 may be configured to deliver the endcap 1602 in close succession to passage of the projectile 118. For example, the endcap delivery system 1616 may be located within the ram accelerator 102, and may launch at non-hypervelocities a endcap 1602 through the launch tube 116 and subsequently through the guide tube 136.

In yet another implementation, the endcap 1602 may be attached, integrated but frangible or separate from but in-contact with the projectile 118. For example, a portion of the projectile 118 may be larger than an exit aperture of the guide tube 136, and may be configured to share or break away from a main body of the projectile 118 to act as the endcap 1602.

The following clauses provide additional description of various embodiments and structures:

1. A method for forming a hole, the method comprising:

inserting an endcap into a first end of a guide tube;

placing the endcap at a position proximate to a second end of the guide tube, wherein the second end is proximate to a working face comprising a geologic material;

loading a projectile into a ram accelerator, wherein:

the projectile is configured to produce a ram-effect combustion reaction in one or more combustible gasses within the ram accelerator; and an output of the ram accelerator is coupled to the first end of the guide tube; boosting the projectile to a ram velocity;

accelerating the projectile along at least a portion of the ram accelerator by combusting one or more combustible gasses in a ram combustion effect; and prior to exit from the guide tube, penetrating the endcap with the projectile.

2. The method of clause 1, further comprising:

forming a barrier, with the endcap, between the second end of the ram accelerator and the geologic material.

3. The method of one or more of clauses 1 or 2, further comprising holding the endcap in the position.

4. The method of one or more of clauses 1 through 3, the placing comprising:

injecting the one or more combustible gasses under pressure at one or more points between the endcap and the first end of the ram accelerator, wherein the one or more combustible gasses exert a pneumatic pressure to displace the endcap along the ram accelerator.

5. The method of one or more of clauses 1 through 4, the placing comprising:

injecting a gas in the ram accelerator at one or more points between the endcap and the first end of the ram accelerator; and igniting the gas.

6. The method of one or more of clauses 1 through 5, further comprising:

before accelerating the projectile, injecting an incombustible gas between the second end of the ram accelerator and the working face, wherein the gas is at a pressure of greater than 6000 kilopascals.

7. The method of one or more of clauses 1 through 6, further comprising:

before placing the endcap, injecting an incombustible gas between the second end of the ram accelerator and the working face, wherein the gas is at a pressure of greater than 6000 kilopascals.

8. A method comprising:

deploying a tube in a hole, the tube comprising a first end proximate to an entry of the hole and a second end proximate to a working face;

deploying an endcap proximate to the second end of the tube; and propelling a projectile through the endcap, using a ram-effect between the projectile and one or more combustible gasses within at least a portion of the tube, at a velocity greater than or equal to two kilometers per second.

9. The method of clause 8, further comprising:

applying a gas at a pressure greater than or equal to a pressure of a formation fluid to a volume in the hole that is between the endcap and the working face.

10. The method of one or more of clauses 8 through 9, further comprising:

forming, in the hole, a pocket of gas between the endcap and at least a portion of the working face.

11. The method of one or more of clauses 8 through 10, further comprising:

after firing, closing a valve located between the first end of the guide tube and the second end of the guide tube.

12. The method of one or more of clauses 8 through 11, the deploying the endcap comprising injecting a gas under pressure at one or more points between the endcap and the first end of the tube, wherein the gas exerts a pneumatic pressure to displace the endcap to the second end of the tube.

13. The method of one or more of clauses 8 through 12, the deploying the endcap comprising applying a negative fluid pressure outside of the second end of the tube to draw the endcap to the second end of the tube.

14. The method of one or more of clauses 8 through 13, the deploying the endcap comprising pushing the endcap to the second end of the tube with a mechanical member.

15. The method of one or more of clauses 8 through 14, the deploying the endcap comprising sinking the endcap to the second end of the tube.

16. A system comprising:

a projectile;

a ram accelerator to accelerate the projectile;

a guide tube having a first end coupled to an exit aperture of the ram accelerator and a second end opposite the first end; and an endcap.

17. The system of clause 16, further comprising:

an endcap delivery system configured to deploy the endcap through an interior of the guide tube to a position proximate to the second end of the guide tube, and wherein the deployed endcap provides a barrier between an interior of the guide tube and an environment external to the guide tube.

18. The system of one or more of clauses 16 through 17, the endcap comprising one or more of:

a plastic, a polymer, a ceramic, an elastomer, a metal, or a composite material.

19. The system of one or more of clauses 16 through 18, further comprising:

a mechanism to hold the endcap proximate to the second end prior to penetration of endcap by the projectile.

20. The system of one or more of clauses 16 through 19, the guide tube comprising one or more valves, wherein each valve when opened permits passage of the endcap and the projectile and when closed each valve prevents fluid passage from one portion of the guide tube to another.

21. A method for drilling a hole, the method comprising:

deploying a drift tube or a guide tube in a hole, the drift tube or a guide tube comprising a first end proximate to an entry of the hole and a second end proximate to a working face;

deploying an endcap at the second end of the drift tube or a guide tube;

applying a purge gas to a volume exterior to the endcap and proximate to the working face; and firing, using a ram accelerator, a ram-effect propelled projectile into the first end of the drift tube or a guide tube.

22. The method of clause 21, wherein the purge gas forms a ullage in the contents of the hole prior to penetration of the projectile.

23. The method of one or more of clauses 21 through 22, wherein the purge gas forms a gas bubble in contact with at least a portion of the endcap prior to penetration of the endcap by the projectile.

24. The method of one or more of clauses 21 through 23, wherein the endcap is destroyed upon impact of the projectile.

25. The method of one or more of clauses 21 through 24, wherein the endcap is penetrated by the projectile.

26. The method of one or more of clauses 21 through 25, wherein the projectile substantially penetrates the endcap and at least a portion of the projectile impacts at least a portion of the working face.

27. The method of one or more of clauses 21 through 26, wherein the endcap comprises a combustible material.

28. The method of one or more of clauses 21 through 27, wherein a shape of the endcap comprises one or more of:

a cylinder, a sphere, or a lenticular or lens shape.

29. The method of one or more of clauses 21 through 28, wherein a shape of the endcap comprises a concavity configured to accept the projectile.

30. The method of one or more of clauses 21 through 30, wherein the endcap forms at least a partial seal between the interior of the drift tube or a guide tube and fluid in the hole.

31. The method of one or more of clauses 21 through 31, wherein the endcap comprises a material configured to expand or swell, and further wherein the endcap provides a seal between the first end and the second end of the drift tube or a guide tube. For example, the endcap may comprise a water-permeable covering filled with a hydrophilic material such as silicone gel. Other materials such as calcium hydroxide, vitreous silica, diiron trioxide, aluminum oxide, and so forth may also be used. Upon exposure to water within the formation fluid 1604, the endcap 1602 may swell, sealing the guide tube 136.

32. The method of one or more of clauses 21 through 32, wherein the endcap comprises a structure configured to change from a first physical configuration to a second physical configuration, wherein the second physical configuration exhibits a greater width than the first physical configuration, and further wherein the endcap provides a seal between the first end and the second end of the drift tube or a guide tube. For example, the endcap may comprise a number of mechanical members which may be displaced such that they provide a radial pressure, increasing a diameter of the endcap, such that the seal is formed.

33. The method of one or more of clauses 21 through 32, the deploying the endcap comprising one or more of:

drawing the endcap by gravity to the second end of the drift tube or a guide tube, applying a positive fluid pressure at the first end of the drift tube or a guide tube to draw the endcap to the second end of the drift tube or a guide tube, applying a negative fluid pressure outside of the second end of the drift tube or a guide tube to draw the endcap to the second end of the drift tube or a guide tube, or pushing the endcap to the second end of the drift tube or a guide tube with a mechanical member.

In one implementation a sequence of ball valves or other section separator mechanisms 126 may be actuated to permit the endcap 1602 to progress to the portion of the tube which is proximate to the working face.

34. A method for drilling a hole, the method comprising:

deploying a tube in a hole, the tube comprising a first end proximate to an entry of the hole and a second end proximate to a working face;

deploying an endcap at the second end of the drift tube or a guide tube; and firing, using a ram accelerator, a ram-effect propelled projectile into the first end of the drift tube or a guide tube and through the endcap to the working face.

35. The method of clause 34, wherein the ram accelerator comprises a baffle-tube ram accelerator.

36. The method of one or more of clauses 34 through 35, further comprising:

applying a purge gas to a volume exterior to the endcap and proximate to the working face to form a cavity within a formation fluid.

The techniques described in this application may be used to drill holes 134 in geologic material 106 or other materials in terrestrial or non-terrestrial settings. For example, the system 100 as described may be used to drill holes 134 here on Earth, on the Earth's Moon, Mars, on asteroids, and so forth.

The ram accelerator 102 may also be used in industrial applications as well, such as in material production, fabrication, and so forth. In these applications a target may comprise materials such as metal, plastic, wood, ceramic, and so forth. For example, during shipbuilding large plates of high strength steel may need to have holes created for piping, propeller shafts, hatches, and so forth. The ram accelerator 102 may be configured to fire one or more of the projectiles 118 through one or more pieces of metal, to form the holes. Large openings may be formed by a plurality of smaller holes around a periphery of the desired opening. Conventional cutting methods such as plasma torches, saws, and so forth may then be used to remove remaining material and finalize the opening for use. In addition to openings, the impact of the projectiles 112 may also be used to form other features such as recesses within the target. The use of the ram accelerator 102 in these industrial applications may thus enable fabrication with materials which are difficult to cut, grind, or otherwise machine.

Furthermore, the projectile 118 may be configured such that during the impact, particular materials are deposited within the impact region. For example, the projectile 118 may comprise carbon such that, upon impact with the target, a diamond coating from the pressures of the impact are formed on the resulting surfaces of the opening. A backstop or other mechanism may be provided to catch the ejecta 606, portions of the projectile 118 post-impact, and so forth. For example, the ram accelerator 102 may be configured to fire through the target material and towards a pool of water.

One or more of the mechanisms or techniques described in this disclosure may be utilized in other ways. For example, the ram accelerator 102 may be used to launch payload into an aerial or orbital trajectory.

Those having ordinary skill in the art will readily recognize that certain steps or operations illustrated in the figures above can be eliminated, combined, subdivided, executed in parallel, or taken in an alternate order. Moreover, the methods described above may be implemented as one or more software programs for a computer system and are encoded in a computer-readable storage medium as instructions executable on one or more processors. Separate instances of these programs can be executed on or distributed across separate computer systems.

Although certain steps have been described as being performed by certain devices, processes, or entities, this need not be the case and a variety of alternative implementations will be understood by those having ordinary skill in the art.

Additionally, those having ordinary skill in the art readily recognize that the techniques described above can be utilized in a variety of devices, environments, and situations. Although the present disclosure is written with respect to specific embodiments and implementations, various changes and modifications may be suggested to one skilled in the art and it is intended that the present disclosure encompass such changes and modifications that fall within the scope of the appended claims.

What is claimed is:

1. A method for forming a hole, the method comprising:

inserting an endcap into a first end of a guide tube;

placing the endcap at a position proximate to a second end of the guide tube, wherein the second end is proximate to a working face comprising a geologic material;

loading a projectile into a ram accelerator, wherein:

the projectile is configured to produce a ram-effect combustion reaction in one or more combustible gasses within the ram accelerator; and an output of the ram accelerator is coupled to the first end of the guide tube;

boosting the projectile to a ram velocity;

accelerating the projectile along at least a portion of the ram accelerator by combusting one or more combustible gasses in a ram combustion effect; and prior to exit from the guide tube, penetrating the endcap with the projectile.

2. The method of claim 1, further comprising:

forming a barrier, with the endcap, between the second end of the ram accelerator and the geologic material.

3. The method of claim 1, further comprising holding the endcap in the position.

4. The method of claim 1, the placing comprising:

injecting the one or more combustible gasses under pressure at one or more points between the endcap and the first end of the ram accelerator, wherein the one or more combustible gasses exert a pneumatic pressure to displace the endcap along the ram accelerator.

5. The method of claim 1, the placing comprising:

injecting a gas in the ram accelerator at one or more points between the endcap and the first end of the ram accelerator; and igniting the gas.

6. The method of claim 1, further comprising:

before accelerating the projectile, injecting an incombustible gas between the second end of the ram accelerator and the working face, wherein the gas is at a pressure of greater than 6000 kilopascals.

7. The method of claim 1, further comprising:

before placing the endcap, injecting an incombustible gas between the second end of the ram accelerator and the working face, wherein the gas is at a pressure of greater than 6000 kilopascals.

8. A method comprising:

deploying a tube in a hole, the tube comprising a first end proximate to an entry of the hole and a second end proximate to a working face;

deploying an endcap proximate to the second end of the tube; and propelling a projectile through the endcap, using a ram-effect between the projectile and one or more combustible gasses within at least a portion of the tube, at a velocity greater than or equal to two kilometers per second.

9. The method of claim 8, further comprising:

applying a gas at a pressure greater than or equal to a pressure of a formation fluid to a volume in the hole that is between the endcap and the working face.

10. The method of claim 8, further comprising:

forming, in the hole, a pocket of gas between the endcap and at least a portion of the working face.

11. The method of claim 8, further comprising:

after firing, closing a valve located between the first end of the guide tube and the second end of the guide tube.

12. The method of claim 8, the deploying the endcap comprising injecting a gas under pressure at one or more points between the endcap and the first end of the tube, wherein the gas exerts a pneumatic pressure to displace the endcap to the second end of the tube.

13. The method of claim 8, the deploying the endcap comprising applying a negative fluid pressure outside of the second end of the tube to draw the endcap to the second end of the tube.

14. The method of claim 8, the deploying the endcap comprising pushing the endcap to the second end of the tube with a mechanical member.

15. The method of claim 8, the deploying the endcap comprising sinking the endcap to the second end of the tube.

* * * * *